US011772377B2

(12) United States Patent
Nishikawa

(10) Patent No.: US 11,772,377 B2
(45) Date of Patent: Oct. 3, 2023

(54) HEAD DRIVE DEVICE, HEAD DEVICE, PRINTING DEVICE, AND HEAD DRIVE METHOD

(71) Applicant: FUJIFILM Corporation, Tokyo (JP)

(72) Inventor: Baku Nishikawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 297 days.

(21) Appl. No.: 17/233,533

(22) Filed: Apr. 18, 2021

(65) Prior Publication Data

US 2021/0237440 A1 Aug. 5, 2021

Related U.S. Application Data

(63) Continuation of application No. PCT/JP2019/042740, filed on Oct. 31, 2019.

(30) Foreign Application Priority Data

Dec. 3, 2018 (JP) ..... 2018-226700

(51) Int. Cl.
*B41J 29/38* (2006.01)
*B41J 2/045* (2006.01)

(52) U.S. Cl.
CPC ..... *B41J 2/04588* (2013.01); *B41J 2/04586* (2013.01)

(58) Field of Classification Search
CPC . B41J 2/04588; B41J 2/04591; B41J 2/04595
See application file for complete search history.

(56) References Cited

U.S. PATENT DOCUMENTS 6,106,092 A * 8/2000 Norigoe ..... B41J 2/04595 347/68
9,522,533 B1 * 12/2016 Seto ..... B41J 2/04588
2005/0151770 A1 * 7/2005 Takeuchi ..... B41J 13/08 347/9
2009/0322815 A1 12/2009 Darby et al.
(Continued)

FOREIGN PATENT DOCUMENTS

JP 2011526850 10/2011
JP 2014210357 11/2014
WO 2012081472 6/2012

OTHER PUBLICATIONS

"International Search Report (Form PCT/ISA/210) of PCT/JP2019/042740," dated Jan. 28, 2020, with English translation thereof, pp. 1-5.

(Continued)

*Primary Examiner* — Lam S Nguyen
(74) *Attorney, Agent, or Firm* — JCIPRNET

(57) ABSTRACT

A drive waveform acquisition unit that acquires a drive waveform, a drive voltage generation unit that generates the drive voltage, a jetting frequency setting unit that sets a jetting frequency on the basis of drop velocity information representing a relationship between the jetting frequency and a drop velocity in a single-shot, and a drive voltage supply unit that supplies the drive voltage to the jetting head are included. The jetting frequency setting unit sets a jetting frequency at which the drop velocity is a second velocity equal to or less than a first velocity in the drop velocity information as the jetting frequency of the jetting head.

17 Claims, 17 Drawing Sheets

(56) References Cited

U.S. PATENT DOCUMENTS

| | | | | |
|---|---|---|---|---|
| 2013/0241985 | A1* | 9/2013 | Furuno | B41J 2/04591 347/10 |
| 2013/0271519 | A1 | 10/2013 | Kubo et al. | |
| 2017/0028721 | A1 | 2/2017 | Barbet et al. | |

OTHER PUBLICATIONS

"Written Opinion of the International Searching Authority (Form PCT/ISA/237) of PCT/JP2019/042740," dated Jan. 28, 2020, with English translation thereof, pp. 1-7.

* cited by examiner

HEAD DRIVE DEVICE, HEAD DEVICE, PRINTING DEVICE, AND HEAD DRIVE METHOD

CROSS-REFERENCE TO RELATED APPLICATIONS

This application is a Continuation of PCT International Application No. PCT/JP2019/042740 filed on Oct. 31, 2019, which claims priority under 35 U.S.C § 119(a) to Japanese Patent Application No. 2018-226700 filed on Dec. 3, 2018. Each of the above application(s) is hereby expressly incorporated by reference, in its entirety, into the present application.

BACKGROUND OF THE INVENTION

1. Field of the Invention

The present invention relates to a head drive device, a head device, a printing device, and a head drive method, and particularly relates to jetting head drive control.

2. Description of the Related Art

In general, ink jet printing machines are required to suppress banding such as white streaks caused by flying curving of a nozzle and a jetting abnormality of a nozzle. In particular, in single-pass type printing machines, streaks are easily generated due to an abnormality of one nozzle. Therefore, a more stable jetting state is required.

Meanwhile, as a trend of recent single-pass type industrial ink jet printing machines, higher productivity is required. The improvement in productivity can be realized by applying a method of thinning out pixels or a method of shortening a recording period per pixel.

In a case where a period in which one type or a plurality of types of liquid droplets can be jetted to one pixel is set as a one-pixel cycle, the printable velocity of the ink jet printing machines is determined on the basis of the pixel cycle. In order to shorten the pixel cycle, a drive method of applying resonance between a jetting head and a liquid is effective. The drive method using the resonance realizes efficient jetting of a specified liquid droplet amount.

WO2012/081472A describes an ink jet recording device to which the drive method using the resonance is applied. The ink jet recording device described in WO2012/081472A discloses a drive waveform so that a jetting velocity of a liquid droplet jetted in a subsequent pixel cycle is not equal to or slower than the jetting velocity of a jetting liquid droplet in a previous pixel cycle.

SUMMARY OF THE INVENTION

However, in a case where a pulse or a pulse group within the one-pixel cycle is connected such that the jetting head and the liquid resonate, the subsequent liquid droplet is excessively accelerated with respect to the preceding liquid droplet. Accordingly, it is possible to impair the stability of continuous liquid droplet jetting. That is, in a case where printing is performed for continuously discharging liquid droplet, it is necessary to control the jetting head capable of both ensuring the stability of the continuous liquid droplet jetting and the efficient liquid droplet jetting.

The challenge of the invention described in WO2012/081472A is to reduce the jetting velocity of a liquid droplet jetted on the basis of a jetting pulse P2, which is the subsequent liquid droplet, with respect to the jetting velocity of a liquid droplet jetted on the basis of a jetting pulse P1, which is the preceding liquid droplet.

That is, WO2012/081472A discloses the polarity of a cancel pulse C1, the pulse width of the cancel pulse C1, and a period between the cancel pulse C1 and the jetting pulse as the conditions that the jetting velocity of the subsequent liquid droplet does not become slow with respect to the jetting velocity of the preceding liquid droplet for the liquid droplets sequentially jetted in a continuous pixel cycle.

Meanwhile, in the invention described in WO2012/081472A, there is a possibility that the subsequent liquid droplet is excessively accelerated with respect to the preceding liquid droplet. Then, in the invention described in WO2012/081472A, it is difficult to ensure the stability of the continuous liquid droplet jetting.

WO2012/081472A does not specifically describe the period S1 and the like from the end timing of the cancel pulse C1 to the end timing of the one-pixel cycle. In FIG. 4 and the like, the period S1 is illustrated so as to be the same as a half cycle AL of the natural vibration cycle of a pressure chamber. However, in a case where an attempt to make the jetting velocity of the subsequent liquid droplet the same as the jetting velocity of the preceding liquid droplet is made and the influence of reverberant vibration on the jetting of the subsequent liquid droplet is to be suppressed, the period S1 should be sufficiently longer than the half cycle AL of the natural vibration cycle of the pressure chamber. The reason will be described below.

The period S inevitably changes in accordance with a jetting frequency. As illustrated in FIG. 9A, FIG. 9B, FIG. 10A, and FIG. 10B, the condition of a jetting frequency at which the jetting velocity of a liquid droplet jetted in second or subsequent cycles is not equal to or smaller than the jetting velocity of a liquid droplet jetted in a first cycle is the band of 20 kHz or less. From the description in Paragraph <0048> of WO2012/081472A, the half cycle AL of the natural vibration cycle of the pressure chamber is 3.3 microseconds. Then, the period S1 is a sufficiently longer period than the half cycle AL of the natural vibration cycle of the pressure chamber.

Moreover, as described in WO2012/081472A, it is practically difficult to almost eliminate the reverberant vibration by using the cancel pulse C1. In order to almost eliminate the reverberant vibration, it is necessary to set a sufficiently long standby period from the end timing of the jetting pulse of the first cycle to the start timing of the jetting pulse of the second cycle.

That is, although WO2012/081472A describes an impractical relationship between the period S1 and the half-cycle AL of the natural vibration cycle of the pressure chamber in Paragraph <0047>, WO2012/081472A does not disclose a relationship between the period S1 and the half cycle AL of the natural vibration cycle of the pressure chamber that is applicable to the provisions of the jetting frequency and is practical.

The present invention has been made in view of such circumstances, and an object thereof is to provide are a head drive device, a head device, a printing device, and a head drive method capable of achieving both ensuring of continuous jetting stability and efficient liquid droplet jetting.

In order to achieve the above object, the following invention aspects are provided.

A head drive device according to a first aspect includes a drive waveform acquisition unit that acquires a drive waveform that is applied to a drive voltage of a one-pixel cycle and includes one or more jetting waveforms having a width of half of a resonant cycle of a jetting head to be driven; a drive voltage generation unit that generates a drive voltage using the drive waveform; a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit. In a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head.

According to the first aspect, a jetting frequency having the second velocity equal to or less than the first velocity, which is the drop velocity in the jetting frequency band where the drop velocity is constant in the drop velocity information, is applied to the jetting frequency of the jetting head. Accordingly, in two or more liquid droplets that generate different pixels, a subsequent droplet following a preceding droplet is not accelerated with respect to the preceding droplet, and it is possible to achieve ensuring of continuous jetting stability and efficient liquid droplet jetting.

The pixel cycle represents the entire period of one or more jetting waveforms used to generate one pixel. The reciprocal of the pixel cycle is the jetting frequency. The pixel cycle includes one or more jetting waveforms. The pixel cycle may include a non jetting waveform.

The drop velocity can be derived by dividing the distance between any two points by a period required for the liquid droplet to pass through the two points.

In a second aspect based on the head drive device of the first aspect, in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit may be configured to set the jetting frequency of the jetting head by using the period $T_1$ that satisfies $$n \times T_c \leq T_1 \leq (n+1/2) \times Tc.$$

According to the second aspect, the jetting frequency at which the jetting timing of the subsequent droplet is adjusted can be applied to the vibration caused by the jetting of the preceding droplet.

In a third aspect based on the head drive device of the first aspect, the jetting frequency setting unit may be configured to set a jetting frequency at which an inclination of a curve representing the drop velocity with respect to the jetting frequency is 0 or less in the drop velocity information as the jetting frequency of the jetting head.

According to the third aspect, it is possible to set the jetting frequency to which the conditions for decelerating the subsequent droplet with respect to the preceding droplet are applied.

In a fourth aspect based on the head drive device of the third aspect, in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit may be configured to set the jetting frequency of the jetting head by using the period $T_1$ that satisfies $$(n+1/4) \times T_c \leq T_1 \leq (n+1/2) \times Tc.$$

According to the fourth aspect, the jetting frequency at which the jetting timing of the subsequent droplet is adjusted can be applied to the vibration caused by the jetting of the preceding droplet.

In a fifth aspect based on the head drive device of any one aspect to the first to fourth aspects, the jetting frequency setting unit may be configured to set a jetting frequency corresponding to a minimum value of a curve representing the drop velocity with respect to the jetting frequency in the drop velocity information as the jetting frequency of the jetting head.

According to the fifth aspect, the jetting frequency to which the conditions for minimizing the drop velocity of the subsequent droplet are applied can be set.

In a sixth aspect based on the head drive device of any one of the first to fifth aspects, the drive waveform acquisition unit may be configured to acquire a jetting waveform including a non jetting waveform continuous with a final waveform element in a final jetting waveform.

According to the sixth aspect, in a case where a plurality of droplet types can be applied, the jetting frequency can be optimized for all the droplet types.

In a seventh aspect based on the head drive device of any one aspect of the first to fifth aspects, the drive waveform acquisition unit may be configured to acquire a drive waveform including a non jetting waveform discontinuous with a final waveform element in a final jetting waveform.

According to the seventh aspect, in a case where a plurality of droplet types can be applied, the jetting frequency can be optimized for one or more droplet types.

An eighth aspect based on the head drive device of any one of the first to seventh aspects may be configured to further include a medium velocity information acquisition unit that acquires medium velocity information representing a movement velocity of a medium; and a jetting frequency adjusting unit that adjusts the jetting frequency using the medium velocity information.

According to the eighth aspect, the jetting frequency can be adjusted on the basis of the medium velocity information representing the movement velocity of the medium.

In such an aspect, the fluctuation of the movement velocity of the medium is a fluctuation factor of the jetting frequency. A medium movement unit that moves the medium preferably has a configuration in which the fluctuation of the movement velocity of the medium is within a certain range.

A head device according to a ninth aspect includes a jetting head; and a head drive device that drives the jetting head. The head drive device includes a drive waveform acquisition unit that acquires a drive waveform that is applied to a drive voltage of one-pixel cycle and includes one or more jetting waveforms having a width of half of a resonant cycle of a jetting head to be driven; a drive voltage generation unit that generates a drive voltage using the drive waveform; a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit. In a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head.

According to the ninth aspect, the same effects as those of the first aspect can be obtained.

In the ninth aspect, the same items as the items specified in the second to eighth aspects can be appropriately combined together. In that case, the components that carry the processing and functions specified in the head drive device can be grasped as the components of the head device that carry the corresponding processing and functions.

A printing device according to a tenth aspect includes a jetting head; and a head drive device that drives the jetting head. The head drive device includes a drive waveform acquisition unit that acquires a drive waveform that is applied to a drive voltage of a one-pixel cycle and includes one or more jetting waveforms having a width of half of a resonant cycle of a jetting head to be driven; a drive voltage generation unit that generates a drive voltage using the drive waveform; a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit. In a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head.

According to the tenth aspect, the same effects as those of the first aspect can be obtained.

In the tenth aspect, the same items as the items specified in the second to eighth aspects can be appropriately combined together. In that case, the components that carry the processing and functions specified in the head drive device can be grasped as the components of the printing device that carry the corresponding processing and functions.

A head drive method according to an eleventh aspect includes a drive waveform acquisition step of acquiring a drive waveform that is applied to a drive voltage of a one-pixel cycle and includes one or more jetting waveforms having a width of half of a resonant cycle of a jetting head to be driven; a drive voltage generation step of generating a drive voltage using the drive waveform; a jetting frequency setting step of setting a jetting frequency of the jetting head on the basis of drop velocity information representing a relationship between the jetting frequency and a drop velocity in a case where a liquid droplet is jetted using the drive voltage of the one-pixel cycle; and a drive voltage supply step of supplying the drive voltage to the jetting head by applying the jetting frequency set in the jetting frequency setting step. In a case where a drop velocity of a jetting frequency band where the drop velocity is constant in the drop velocity information is defined as a first velocity and a drop velocity equal to or less than the first velocity is defined as a second velocity, the jetting frequency setting step sets a jetting frequency at which the drop velocity is the second velocity as the jetting frequency of the jetting head.

According to the eleventh aspect, the same effects as those of the first aspect can be obtained.

In the eleventh aspect, the same items as the items specified in the second to eighth aspects can be appropriately combined together. In that case, the components that carry the processing and functions specified in the head drive device can be grasped as the components of the head drive method that carry the corresponding processing and functions.

According to the present invention, a jetting frequency having the second velocity equal to or less than the first velocity, which is the drop velocity in the jetting frequency band where the drop velocity is constant in the drop velocity information, is applied to the jetting frequency of the jetting head. Accordingly, in two or more liquid droplets that generate different pixels, a subsequent droplet following a preceding droplet is not accelerated with respect to the preceding droplet, and it is possible to achieve ensuring of continuous jetting stability and efficient liquid droplet jetting.

DESCRIPTION OF THE PREFERRED EMBODIMENTS

Hereinafter, preferred embodiments of the present invention will be described in detail with reference to the accompanying drawings. In the present specification, the same components will be denoted by the same reference signs, and overlapping descriptions thereof will be appropriately omitted.

[Ink Jet Printing Device]

[Overall Configuration]

Figure 1:
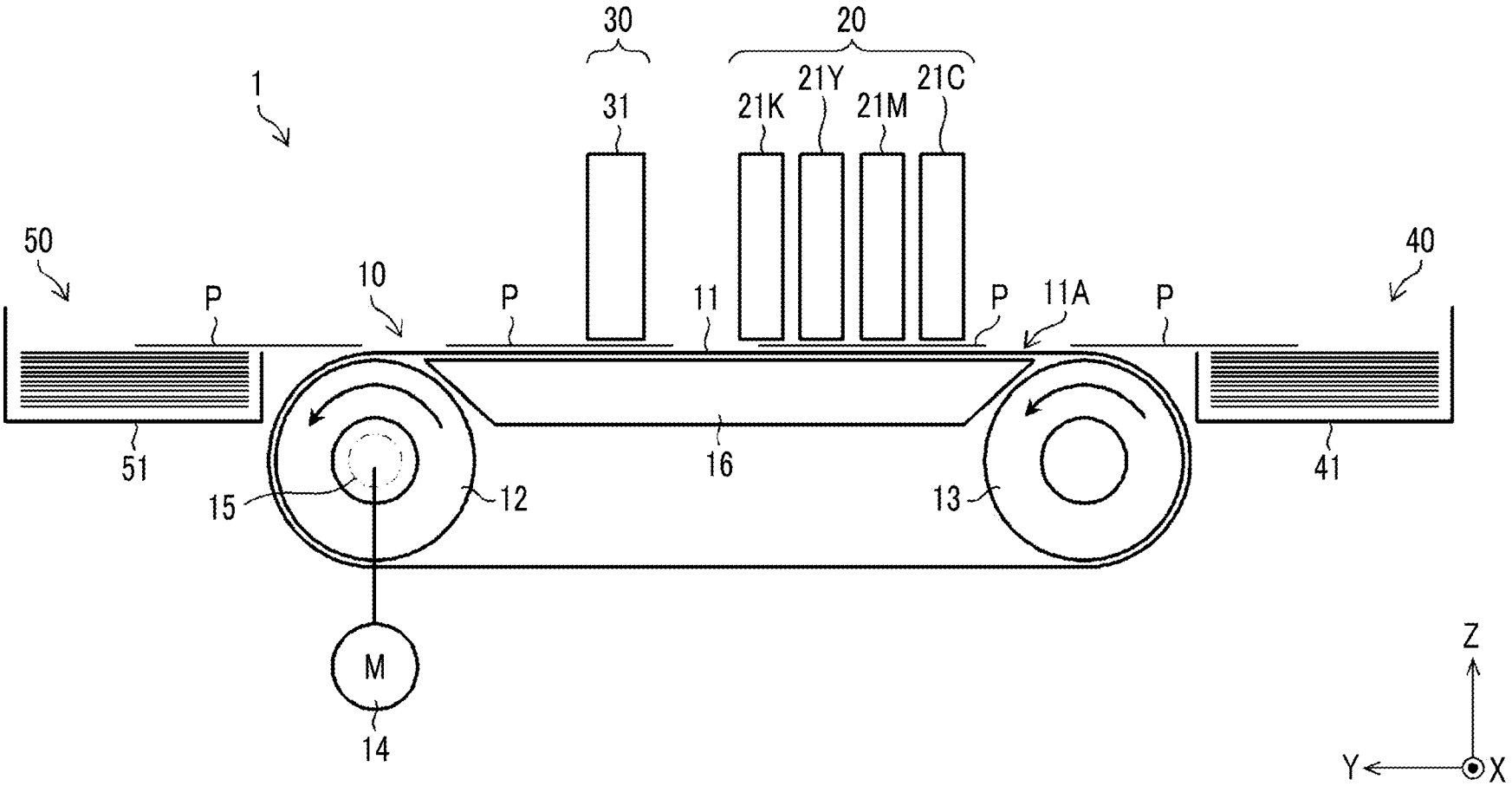
FIG. 1 is an overall configuration diagram of an ink jet printing device.

FIG. 1 is an overall configuration diagram of an ink jet printing device. The ink jet printing device 1 is a digital printing device that prints an image on paper P by applying a single-pass type. As the paper P, a sheet-like medium referred to as a recording paper, a printing paper, or the like can be applied. The term printing in the present specification may be replaced with terms such as image forming and image recording.

The ink jet printing device 1 includes a paper transport unit 10, a printing unit 20, a reading unit 30, a paper feed unit 40, and a stacking unit 50. Hereinafter, respective units of the ink jet printing device 1 will be described in detail.

[Paper Transport Unit]

The paper transport unit 10 transports the paper P supplied from the paper feed unit 40 along a specified transport route. The paper transport unit 10 has a suction belt transport mechanism that suctions and transports the paper P on a traveling belt 11.

The paper transport unit 10 includes a belt 11, a drive roller 12, a driven roller 13, a motor 14, a rotary encoder 15, and a suction unit 16. The belt 11 is wound around the drive roller 12 and the driven roller 13. The motor 14 is coupled to the drive roller 12 via a coupling mechanism (not illustrated). The rotary encoder 15 is attached to a rotation shaft of the drive roller 12.

The motor 14 is driven to rotate the drive roller 12. The drive roller 12 and the driven roller 13 rotate in a rotational direction indicated by an arrow line. The belt 11 travels in accordance with the rotation of the drive roller 12 and the driven roller 13.

A paper support surface 11A of the belt 11 that suctions and supports the paper P is provided with suction holes (not illustrated). The suction holes communicate with the suction unit 16. The suction unit 16 is coupled to a pump (not illustrated) via a flow channel (not illustrated). The pump is operated to generate a negative pressure in the suction unit 16. The negative pressure generated in the suction unit 16 acts on the paper P via the suction holes of the belt 11. Accordingly, the paper P is suctioned and supported by the belt 11.

[Printing Unit]

The printing unit 20 applies the ink jet method to print an image on paper P. The image may include texts, symbols, figures, lines, and the like. The printing unit 20 includes a jetting head 21C, a jetting head 21M, a jetting head 21Y, and a jetting head 21K.

The jetting head 21C, the jetting head 21M, the jetting head 21Y, and the jetting head 21K are disposed in order of the jetting head 21C, the jetting head 21M, the jetting head 21Y, and the jetting head 21K in a transport direction of the paper P.

Hereinafter, there is a case where the transport direction of the paper P is described as a paper transport direction. Additionally, there is a case where a width direction of the paper P, which is a direction orthogonal to the paper transport direction and parallel to a transport surface of the paper P, is described as a paper width direction. In FIG. 1, a direction indicated using a reference sign X and a direction opposite to the direction indicated using the reference sign X are the paper width direction. A direction indicated using a reference sign Y is the paper transport direction. A direction indicated using a reference sign Z is the vertical direction.

Here, the term "orthogonal" in the present specification may include "being substantially orthogonal" in which it is possible to obtain the same operational effects as those in a case where an angle at which two directions intersect each other is 90 degrees, even in a case where the angle at which the two directions intersect each other is less than 90 degrees and a case where the angle at which the two directions intersect each other exceeds 90 degrees. Additionally, the term "parallel" in the present specification may include "being substantially parallel" in which it is possible to the same operational effects as those in the case where two directions are parallel even in a case where the two directions intersect each other.

The jetting head 21C jets cyan ink. The jetting head 21M jets magenta ink. The jetting head 21Y jets yellow ink. The jetting head 21K jets black ink.

The jetting head 21C, the jetting head 21M, the jetting head 21Y, and the jetting head 21K are line-type heads having an effective recording width corresponding to the total length of the paper P in the width direction of the paper P orthogonal to the paper transport direction. In addition, the line-type heads may be referred to as line heads, full-line heads, page wide heads, or the like. In addition, the jetting head 21C, the jetting head 21M, the jetting head 21Y, and the jetting head 21K illustrated in the embodiment are examples of the jetting heads to be driven.

[Reading Unit]

The reading unit 30 optically reads the image printed on the paper P and generates image data representing the read image. The reading unit 30 includes an in-line scanner 31. The in-line scanner 31 includes an image pick-up device (not illustrated). The image pick-up device captures the image printed on the paper P and converts the captured image into an electrical signal.

As the in-line scanner 31, a line scanner may be applied. As the image pick-up device, a CCD linear image sensor, a CMOS linear image sensor, or the like can be applied. CCD is an abbreviation for Charge-Coupled Device. CMOS is an abbreviation for Complementary Metal Oxide Semiconductor.

The in-line scanner 31 includes an illumination device and a signal processing circuit. The illumination device irradiates a reading target with illumination light. The signal processing circuit processes the electrical signal output from the image pick-up device to generate image data. In addition, the illustration of the illumination device and the signal processing circuit are omitted.

<Paper Feed Unit>

The paper feed unit 40 includes a paper feed device (not illustrated). The paper feed device supplies the paper P placed on a paper feed tray 41 to the paper transport unit 10 one by one. As the paper feed unit 40, a known configuration may be applied.

<Stacking Unit>

The stacking unit 50 receives the paper P on which the image is printed from the paper transport unit 10. The stacking unit 50 stacks the paper P on which the image is printed on a stacking tray 51.

[Detailed Description of Jetting Head]

Figure 2:
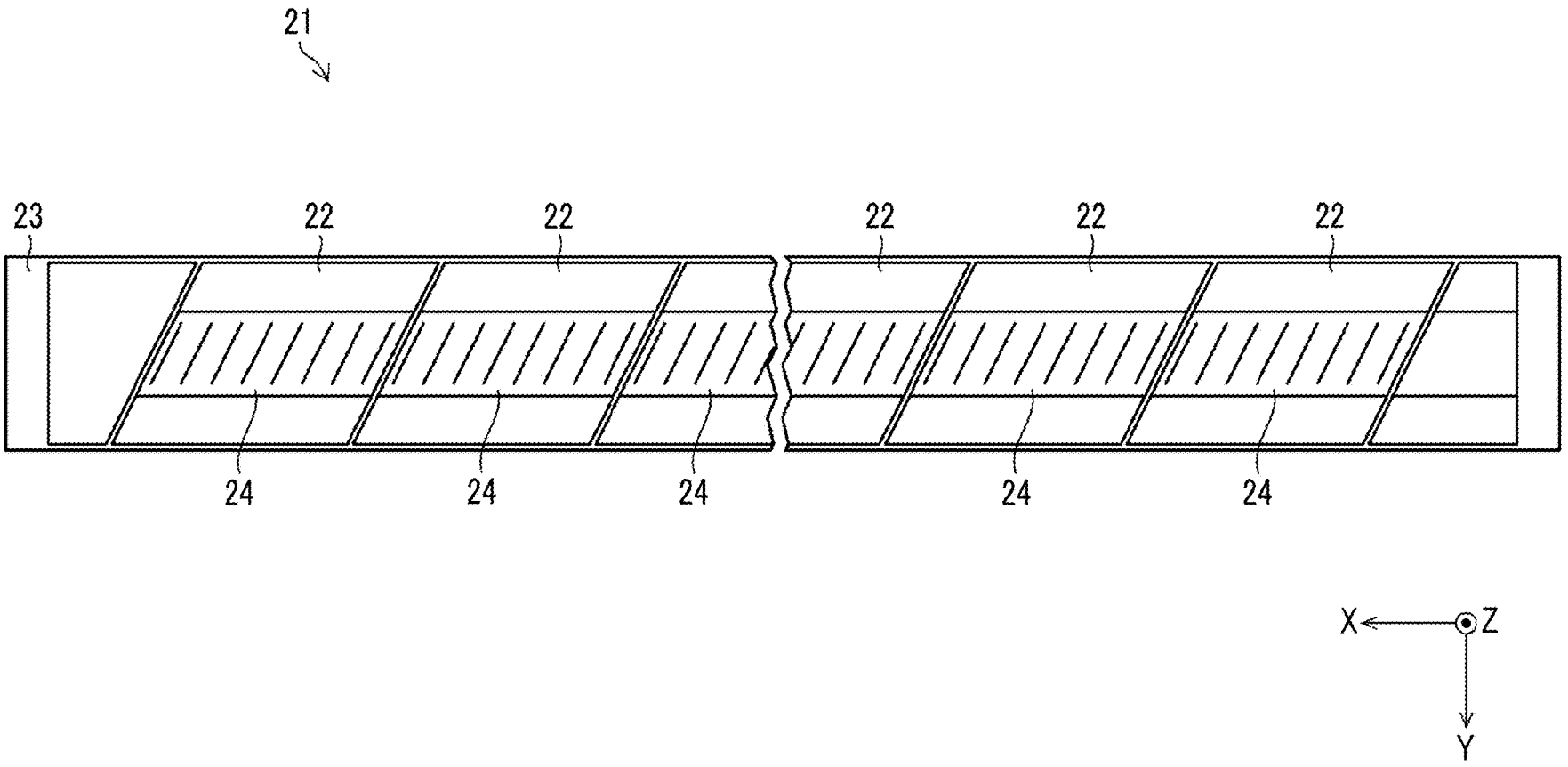
FIG. 2 is a bottom view illustrating a schematic configuration of a jetting head.

FIG. 2 is a bottom view illustrating a schematic configuration of a jetting head. FIG. 2 is a view of the jetting head 21 as viewed from a nozzle surface 24 side. As the jetting head 21C, the jetting head 21M, the jetting head 21Y, and the jetting head 21K illustrated in FIG. 1, the same structure can be applied. FIG. 2 illustrates the jetting head 21 as any jetting head of the jetting head 21C, the jetting head 21M, the jetting head 21Y, and the jetting head 21K.

The jetting head 21 has a structure in which a plurality of head modules 22 are connected together in a longitudinal direction of the jetting head 21. As the plurality of head modules 22, the same structure may be applied. In addition, the number of head modules 22 is not limited and is appropriately determined in accordance with the total length of the paper P used in the paper width direction.

The plurality of head modules 22 are attached to a base frame 23. The base frame 23 includes attachment parts according to the number of attachable head modules 22. The base frame 23 includes an adjusting part that adjusts the positions of the head modules 22. In addition, the illustration of the attachment parts and the adjusting part are omitted.

Figure 3:
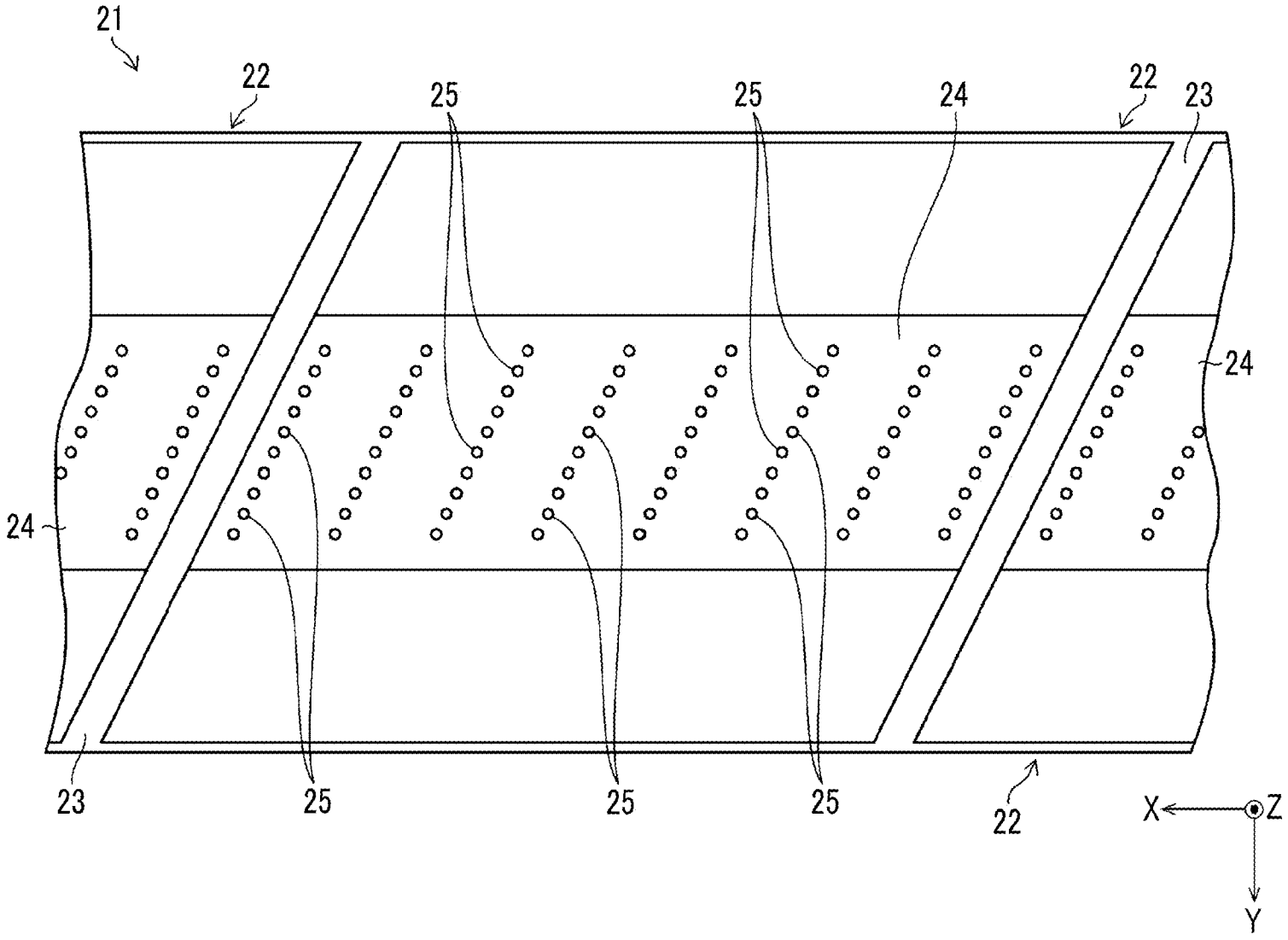
FIG. 3 is a view schematically illustrating a configuration example of a nozzle surface of the jetting head.

FIG. 3 is a view schematically illustrating a configuration example of the nozzle surface of the jetting head. In each head module 22, a plurality of nozzles 25 are formed on the nozzle surface 24. The positions of the respective head modules 22 in the vertical direction are adjusted such that the respective nozzle surfaces 24 constitute the same plane.

The plurality of nozzles 25 have an arrangement density that realizes a specified print resolution. A matrix arrangement is applied to the plurality of nozzles 25. A projection nozzle line in which the plurality of nozzles 25 are projected in the medium width direction is equivalent to a row of nozzle lines in which the plurality of nozzles 25 are disposed at substantially regular intervals in the paper width direction.

The "substantially regular intervals" means that droplet striking points capable of forming dots using the jetting head are disposed at substantially regular intervals. For example, a case where the nozzles 25 having slightly different intervals are included in consideration of the movement of a liquid droplet on the paper P due to manufacturing errors and landing interference is also included in the concept of regular intervals. In the present specification, in a case where the positional relationship of the nozzles 25 is described, the positional relationship means the positional relationship of the nozzles 25 in the projection nozzle line unless otherwise specified.

A column direction in the matrix arrangement may be a direction that obliquely intersects a row direction. Additionally, the row direction may be a direction parallel to the paper width direction or a direction non-parallel to the paper width direction. The arrangement of the nozzles 25 of the head module 22 is not limited to the matrix arrangement. Examples of the arrangement of the nozzles 25 include a row of linear arrangement, a V-shaped arrangement, and a W-shaped arrangement having the V-shaped arrangement as a repeating unit.

Figure 4:
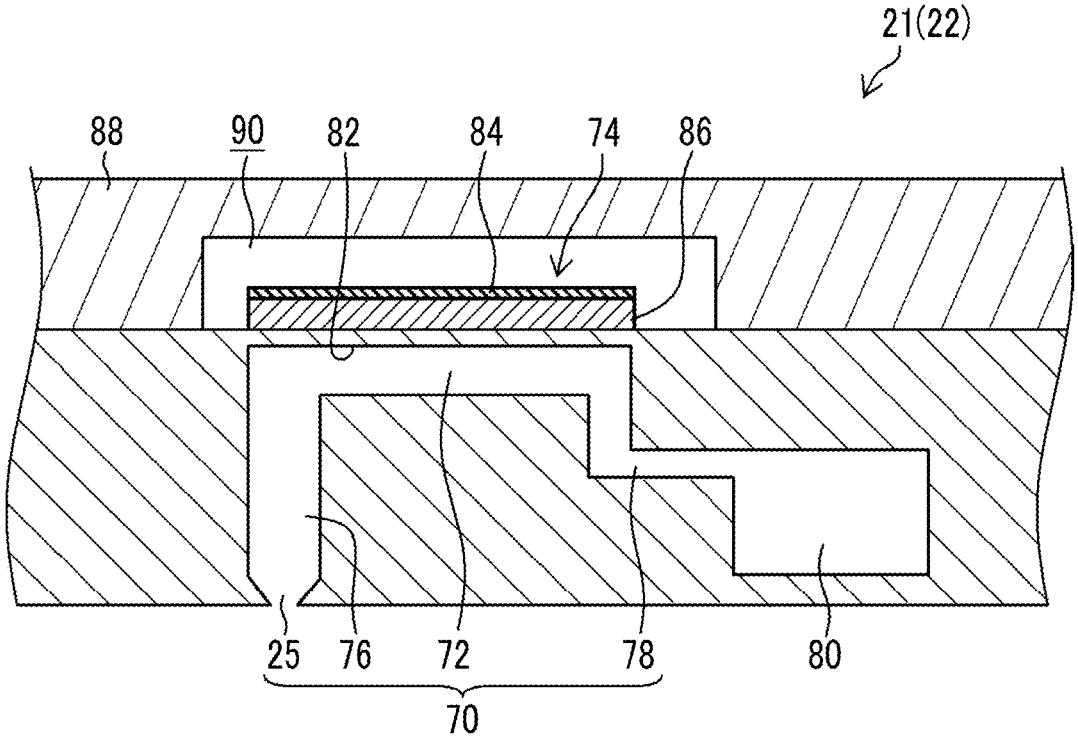
FIG. 4 is a cross-sectional view illustrating a structural example of the jetting head.

FIG. 4 is a cross-sectional view illustrating a structural example of the jetting head. The ejector 70 includes a nozzle 25, a pressure chamber 72, and a piezoelectric element 74. The nozzle 25 communicates with the pressure chamber 72 via a nozzle flow channel 76. The pressure chamber 72 communicates with a supply-side common branch flow channel 80 via an individual supply passage 78.

A vibration plate 82 that constitutes a top surface of the pressure chamber 72 includes a conductive layer that functions as a common electrode corresponding to a lower electrode of the piezoelectric element 74. In addition, the illustration of the conductive layer is omitted. The pressure chamber 72, wall portions of the other flow channel portions, the vibration plate 82, and the like can be made of silicon.

The material of the vibration plate 82 is not limited to silicon, and an aspect is also possible in which the vibration plate may be formed of a non-conductive material such as resin. The vibration plate 82 itself may be made of a metallic material such as stainless steel to serve as a common electrode.

A piezoelectric unimorph actuator is configured by a structure in which the piezoelectric element 74 is laminated on the vibration plate 82. A drive voltage is applied to an individual electrode 84, which is an upper electrode of the piezoelectric element 74, to deform a piezoelectric body 86, and the vibration plate 82 is bent to change the volume of the pressure chamber 72. A pressure change accompanying the volume change of the pressure chamber 72 acts on ink, and the ink is jetted from the nozzle 25.

In a case where the piezoelectric element 74 returns to its original state after ink is jetted, the pressure chamber 72 is filled with new ink from the supply-side common branch flow channel 80 through the individual supply passage 78. The operation of filling the pressure chamber 72 with the ink is referred to as refilling.

The shape, in plan view, of the pressure chamber 72 is not particularly limited and may be various forms such as a quadrangular shape or other polygonal shapes, a circular shape, or an elliptical shape. A cover plate 88 is a member that keeps a movable space 90 of the piezoelectric element 74 and seals the periphery of the piezoelectric element 74.

Above the cover plate 88, a supply-side ink chamber and a recovery-side ink chamber (not illustrated) are formed. The supply-side ink chamber is coupled to a supply-side common main flow channel (not illustrated) via a communication passage (not illustrated). The recovery-side ink chamber is coupled to a recovery-side common main flow channel (not illustrated) via a communication passage (not illustrated).

[Functional Block of Ink Jet Printing Device]

Figure 5:
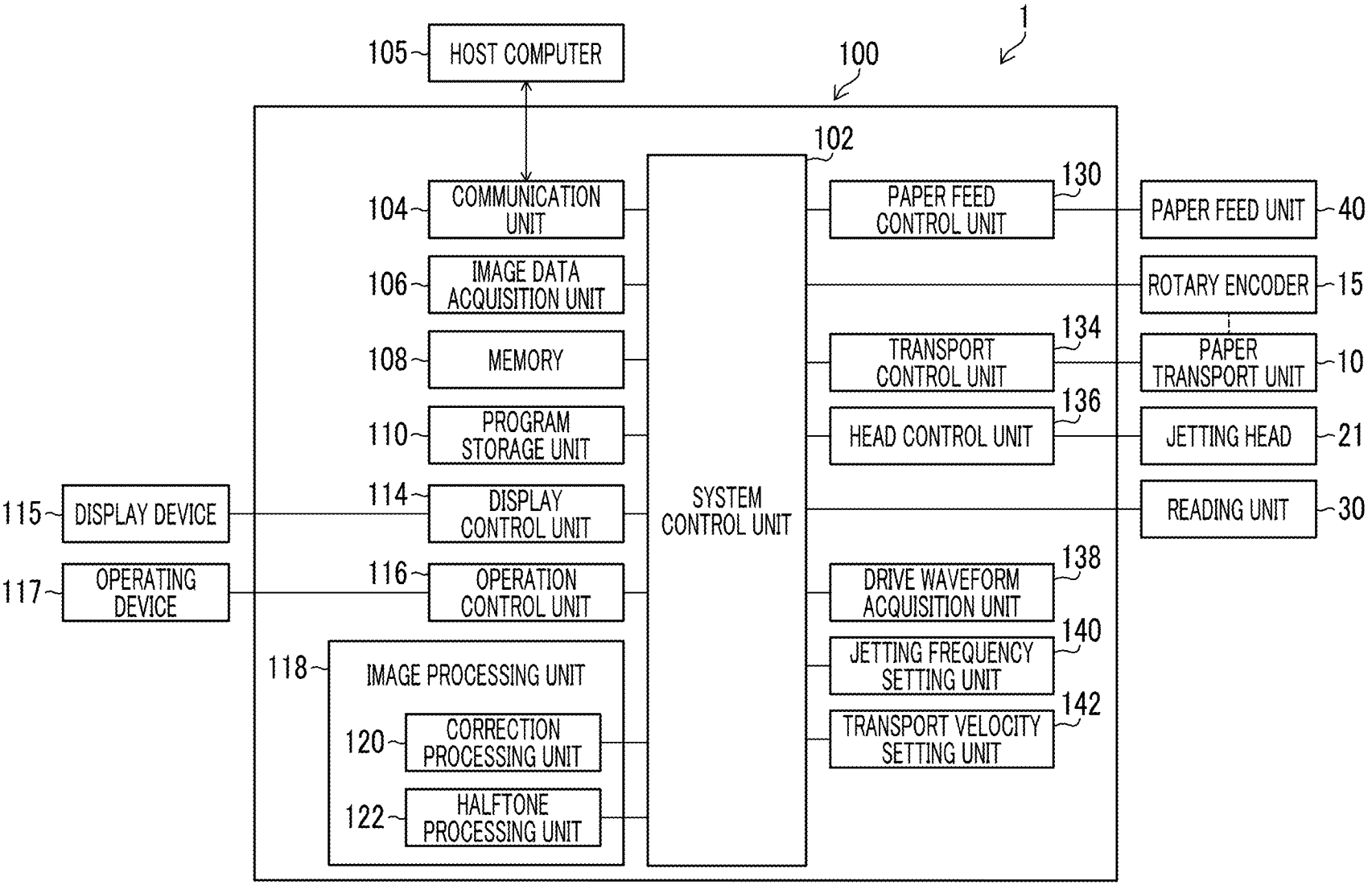
FIG. 5 is a functional block diagram of an ink jet printing device

FIG. 5 is a functional block diagram of the ink jet printing device. The ink jet printing device 1 is controlled by using a control device 100. The control device 100 may be realized by combining the hardware and software of a computer. The software is synonymous with a program.

The control device 100 includes a system control unit 102. The system control unit 102 includes a central arithmetic unit, peripheral circuits, and the like. The system control unit 102 operates in accordance with a control program.

The control device 100 includes a program storage unit 110. The program storage unit 110 stores a program executed by the system control unit 102. The control device 100 includes a parameter storage unit that stores various parameters used in a case where the program is executed. The program storage unit 110 may also be used as a parameter storage unit.

The control device 100 includes a communication unit 104. The communication unit 104 includes a specified communication interface. The control device 100 is communicably connected to a host computer 105 via the communication unit 104. The control device 100 may transmit and receive data to and from the host computer 105 via the communication unit 104. As the connection between the control device 100 and the host computer 105, wired, wireless, or a combination of wired and wireless may be applied. The communication unit 104 may include a buffer memory for speeding up communication.

The control device 100 includes an image data acquisition unit 106. The image data acquisition unit 106 is an interface for acquiring image data representing an image to be printed. The format of the image data is not limited. An example of the image data is an RGB image in which each color of RGB is represented by 256 gradations. CMYK may be applied instead of RGB. Additionally, the number of gradations of each color is not limited to 256 gradations.

In addition, R of RGB represents red. B represents blue. G represents green. Additionally, C in CMYK represents cyan. M represents magenta. Y represents yellow. K represents black.

As the image data acquisition unit 106, a data input terminal that captures the image data from a signal processing unit outside the ink jet printing device 1 or inside the ink jet printing device 1 may be applied. As the image data acquisition unit 106, a wired or wireless communication interface may be applied. As the image data acquisition unit 106, a media interface for reading and writing a portable storage medium such as a memory card may be applied.

As the image data acquisition unit 106, a combination of the data input terminal, the communication interface, and the media interface may be applied. The communication unit 104 can fulfill the function of the image data acquisition unit 106.

The control device 100 includes a memory 108. The memory 108 primarily stores various data including the image data acquired by using the image data acquisition unit 106.

The control device 100 includes a display control unit 114. The display control unit 114 transmits, to the display device 115, display signals representing various information to be displayed by using the display device 115. As the display device 115, a monitor device may be applied. The display control unit 114 functions as a display driver that controls the monitor device.

The control device 100 includes an operation control unit 116. The operation control unit 116 is an input interface for acquiring an input signal transmitted from the operating device 117. As the operating device 117, a keyboard, a mouse, and the like may be applied.

The display device 115 and the operating device 117 constitute a user interface. A touch panel type display device may be applied to integrally configure the display device 115 and the operating device 117.

An operator may operate the operating device 117 while observing the contents displayed on a screen of the display device 115 to perform of printing conditions, input of various information such as selection of a printing mode, editing of various information, searching of various information, and the like. The operator may confirm the input contents and the like through the screen of the display device 115.

The control device 100 includes an image processing unit 118. The image processing unit 118 includes a correction processing unit 120 and a halftone processing unit 122. The correction processing unit 120 performs various transformation processing and various correction processing on the image data.

The transformation processing may include pixel number transformation, gradation transformation, color transformation, and the like. The correction processing may include density correction adapted to the characteristics of the jetting head 21, abnormal nozzle correction for correcting the visibility of image defects caused by an abnormal nozzle, and the like.

The halftone processing unit 122 performs halftone processing for transforming the image data of each color of CMYK into binary or multi-valued dot image data. Examples of halftone processing rules include known halftone processing rules such as the dither method and the error diffusion method. The halftone processing is generally the processing of quantizing multi-gradation image data having three or more gradation values to transform the quantized image data into data having gradation values that are capable of being recorded by using the jetting head 21 and less than the gradation values of the image data.

The jetting head 21 of the ink jet printing device 1 can separate three droplet types: large droplets, medium droplets, and small droplets. The halftone processing unit 122 converts separation image data of each color of multiple gradations such as 256 gradations into quaternary signals of large droplets, medium droplets, small droplets, and no droplets. In a case where a large droplet is jetted, a large dot is formed on the paper P, in a case where a medium droplet is jetted, a medium dot is formed on the paper P, and in a case where a small droplet is jetted, a small dot is formed on the paper P.

The control device 100 includes a paper feed control unit 130. The paper feed control unit 130 controls the operation of the paper feed unit 40 on the basis of a command signal transmitted from the system control unit 102.

The control device 100 includes a transport control unit 134. The transport control unit 134 controls the operation of the paper transport unit 10 on the basis of the command signal transmitted from the system control unit 102. For example, the transport control unit 134 includes a motor driver that controls the operation of the motor 14 illustrated in FIG. 1.

The control device 100 acquires an output signal of the rotary encoder 15 via an encoder output signal acquisition unit (not illustrated). The control device 100 generates a jetting trigger signal from the output signal of the rotary encoder 15. The jetting timing of the jetting head 21 is synchronized with the output signal of the rotary encoder 15. Accordingly, the landing position of a liquid droplet can be determined with high accuracy.

The control device 100 includes a head control unit 136. The head control unit 136 controls the driving of the jetting head 21 on the basis of the command signal transmitted from the system control unit 102. The command signal referred to herein includes a jetting trigger. The head control unit 136 controls the driving of the jetting head 21 on the basis of the dot data of each color generated via the halftone processing of the halftone processing unit 122 and causes an image to be formed on the paper P.

The head control unit 136 includes a drive waveform acquisition unit 138 and a drive voltage generation unit (not illustrated in FIG. 5). The drive waveform acquisition unit 138 acquires a drive waveform. Examples of a mode in which the drive waveform is acquired include a mode in which the drive waveform is acquired from an external device via the input interface, a mode in which the drive waveform is read out from a storage device inside the control device 100, and the like.

Figure 6:
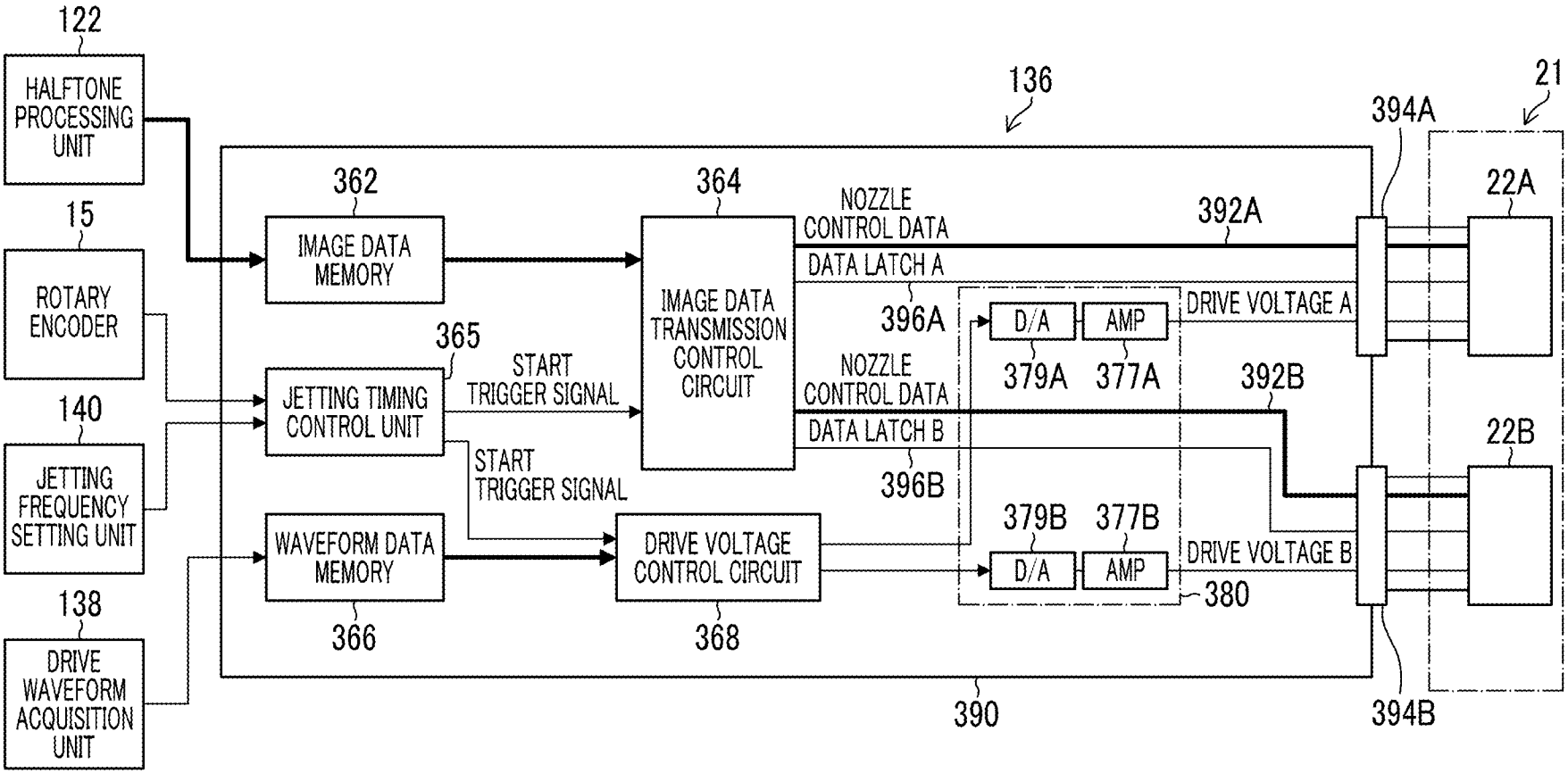
FIG. 6 is a functional block diagram illustrating a configuration example of a head control unit.

The drive voltage generation unit generates a drive voltage on the basis of the drive waveform acquired by using the drive waveform acquisition unit 138. The drive voltage generation unit performs voltage amplification and current amplification on the drive waveform to generate the drive voltage having a specified voltage value. In addition, the drive voltage generation unit is designated by reference sign 380 and is illustrated in FIG. 6.

The head control unit 136 includes a drive voltage output circuit (not illustrated). The drive voltage output circuit supplies a drive voltage to the piezoelectric element 74 provided in the jetting head 21. In addition, the drive voltage output unit illustrated in the embodiment is an example of a component of a drive voltage supply unit.

The control device 100 acquires an output signal of the reading unit 30 via an input interface (not illustrated). The control device 100 grasps the jetting state of the jetting head 21 by using the output signal of the reading unit 30. An example of the jetting state of the jetting head 21 is the occurrence of an abnormal nozzle. The abnormal nozzle may include a non jetting nozzle that does not jet a liquid droplet, a flying curving nozzle in which the flying curving of a liquid droplet occurs, or the like.

The control device 100 includes the drive waveform acquisition unit 138. The drive waveform acquisition unit 138 stores the drive waveform in the waveform data memory 366 illustrated in FIG. 6. The drive waveform acquisition unit 138 may acquire the drive waveform from an external device such as the host computer 105, or may acquire the drive waveform from the storage medium via an input interface (not illustrated). As the input interface (not illustrated), a slot or the like configured such that a storage medium is attachable and detachable may be applied.

The control device 100 includes a jetting frequency setting unit 140. The jetting frequency setting unit 140 transmits information on jetting frequency to the head control unit 136. The head control unit 136 controls the jetting timing of the jetting head 21 by applying the jetting frequency transmitted from the jetting frequency setting unit 140.

The control device 100 includes a transport velocity setting unit 142. The transport velocity setting unit 142 sets the transport velocity of the paper P. The transport velocity setting unit 142 may set the transport velocity of the paper P on the basis of information on the transport velocity of the paper P input by using the operating device 117. The transport velocity setting unit 142 transmits the information on the transport velocity to the jetting frequency setting unit 140. The jetting frequency setting unit 140 sets the jetting frequency on the basis of the information on the transport velocity of the paper P transmitted from the transport velocity setting unit 142.

The control device 100 can be realized by one or a plurality of computers. The processing units of the control device 100 may be configured by using one or a plurality of central processing units (CPUs). The one or the plurality of CPUs operate by loading the program stored in the program storage unit 110 into the CPU. Some or all of the processing functions of the control device 100 may be realized by using an integrated circuit represented by a digital signal processor (DSP), a field-programmable gate array (FPGA), or the like.

[Detailed Description of Head Control Unit]

FIG. 6 is a functional block diagram illustrating a configuration example of the head control unit. FIG. 6 illustrates a configuration example of the head control unit 136 in a case where the jetting head 21 includes a first head module 22A and a second head module 22B, supplies a drive voltage A to the first head module 22A, and supplies a drive voltage B to the second head module 22B.

The head control unit 136 includes an image data memory 362, an image data transmission control circuit 364, a jetting timing control unit 365, a waveform data memory 366, and a drive voltage control circuit 368.

Additionally, the head control unit 136 includes a first digital-to-analog converter 379A, a second digital-to-analog converter 379B, a first power amplifier circuit 377A, and a second power amplifier circuit 377B.

The image data transmission control circuit 364 includes a latch signal transmission circuit (not illustrated). A data latch signal is output at an appropriate timing from the image data transmission control circuit 364 to the jetting head 21. In addition, the data latch signal is a general term for a data latch A and a data latch B illustrated in FIG. 6.

The image data memory 362 stores the dot data generated by using the halftone processing unit 122 illustrated in FIG. 5. The waveform data memory 366 stores digital data indicating the drive waveform. The waveform data memory 366 stores the drive waveform acquired by using the drive waveform acquisition unit 138 illustrated in FIG. 5. The waveform data memory 366 may store the drive waveform generated by a drive waveform generation unit (not illustrated) via the drive waveform acquisition unit 138.

The image data memory 362 acquires the dot data corresponding to the image data to be printed in synchronization with the transport of the paper P during printing execution. The jetting timing control unit 365 acquires a trigger signal based on the output signal of the rotary encoder 15. The jetting timing control unit 365 transmits a start trigger signal to the image data transmission control circuit 364 and the drive voltage control circuit 368.

The image data transmission control circuit 364 receives the start trigger signal and transmits the dot data to the jetting head 21 in synchronization with the start trigger signal. The drive voltage control circuit 368 receives the start trigger signal and transmits the drive waveform to the first digital-to-analog converter 379A and the second digital-to-analog converter 379B in synchronization with the start trigger signal. Accordingly, the printing based on the jetting drive control of a selective drop-on-demand according to the image data is realized.

The first digital-to-analog converter 379A and the second digital-to-analog converter 379B convert a digital-format drive waveform into an analog-format voltage waveform. The output waveform of the first digital-to-analog converter 379 is amplified to a current and a voltage suitable for driving the piezoelectric element by using the first power amplifier circuit 377A. Similarly, the voltage waveform output from the second digital-to-analog converter 379B is amplified to a current and a voltage suitable for driving the piezoelectric element by using the second power amplifier circuit 377B.

The drive voltage A output from the first power amplifier circuit 377A is supplied to the first head module 22A. The drive voltage output from the second power amplifier circuit 377B is supplied to the second head module 22B.

The first power amplifier circuit 377A, the second power amplifier circuit 377B, the first digital-to-analog converter 379A, and the second digital-to-analog converter 379B constitute a drive voltage generation unit 380 that generates the drive voltage using the drive waveform.

The image data transmission control circuit 364 performs the control of transmitting nozzle control data of the first head module 22A and the second head module 22B to the first head module 22A and the second head module 22B, respectively, on the basis of the dot data stored in the image data memory 362.

The nozzle control data is image data for determining jetting drive or non-drive of the nozzles. The image data transmission control circuit 364 transmits the nozzle control data to each head module 22. Accordingly, the jetting drive or non-drive for each nozzle is controlled.

A first nozzle control data transmission line 392A that transmits the nozzle control data output from the image data transmission control circuit 364 to the first head module 22A is referred to as an image data bus, a data bus, an image bus, or the like. The same applies to a second nozzle control data transmission line 392B.

The first nozzle control data transmission line 392A and the second nozzle control data transmission line 392B are configured to include a plurality of signal lines. One end of the first nozzle control data transmission line 392A and one end of the second nozzle control data transmission line 392B are connected to an output terminal of the image data transmission control circuit 364.

The other end of the first nozzle control data transmission line 392A is connected to the first head module 22A via a first connector 394A. The other end of the second nozzle control data transmission line 392B is connected to the second head module 22B via a second connector 394B. In addition, the first connector 394A and the second connector 394B described in the embodiment may be used as an example of the components of the drive voltage supply unit.

The first nozzle control data transmission line 392A and the second nozzle control data transmission line 392B may be configured by an electric wiring pattern of an electric circuit board on which the image data transmission control circuit 364, the drive voltage control circuit 368, and the like are mounted.

As the first nozzle control data transmission line 392A and the second nozzle control data transmission line 392B, a wire harness may be applied. The first nozzle control data transmission line 392A and the second nozzle control data transmission line 392B may be configured by combining the wiring pattern of the electric circuit board and the wire harness.

A first latch signal line 396A that transmits the data latch A is connected to a signal input terminal of the first head module 22A via the first connector 394A. The second latch signal line 396B that transmits the data latch B is connected to a signal input terminal of the second head module 22B via the second connector 394B.

The data latch A is transmitted at a required timing from the image data transmission control circuit 364 to the first head module 22A in order to set the nozzle data signals transmitted via the first nozzle control data transmission line 392A as the nozzle data of the first head module 22A.

The data latch B is transmitted at a required timing from the image data transmission control circuit 364 to the second head module 22B in order to set the nozzle data signals transmitted via the second nozzle control data transmission line 392B as the nozzle data of the second head module 22B.

The image data transmission control circuit 364 transmits the data latch A to the first head module 22A at a timing when a certain amount of image data is transmitted to the first head module 22A via the first nozzle control data transmission line 392A.

The image data transmission control circuit 364 transmits the data latch B to the second head module 22B at a timing when a certain amount of image data is transmitted to the second head module 22B via the second nozzle control data transmission line 392B.

The jetting drive or non-drive data of the piezoelectric element in the first head module 22A is determined at a timing represented by the data latch A. Additionally, the jetting drive or non-drive data of the piezoelectric element in the second head module 22B is determined at a timing represented by the data latch B. Thereafter, a drive voltage is supplied to the first head module 22A and the second head module 22B, and the piezoelectric element in which the jetting drive is performed is deformed to jet ink. The ink jetted in this way is made to adhere to a medium, and printing with a desired resolution is performed.

[Flowchart of Jetting Head Drive Method]

Figure 7:
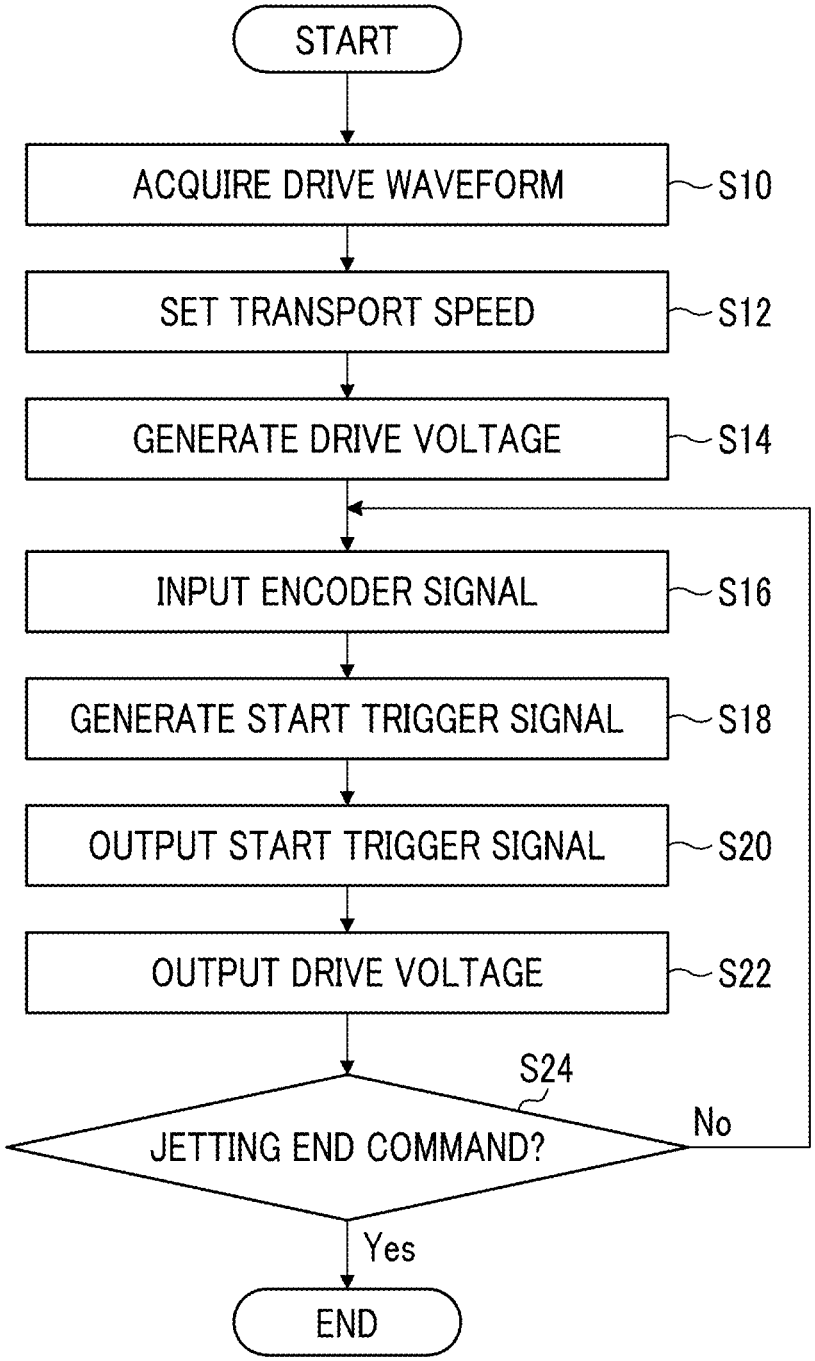
FIG. 7 is a flowchart illustrating a procedure of a head drive method.

FIG. 7 is a flowchart illustrating a procedure of a head drive method. The jetting head drive method includes a drive waveform acquisition Step S10, a transport velocity setting Step S12, a drive voltage generation Step S14, an encoder signal input Step S16, a start trigger signal generation Step S18, a start trigger signal output Step S20, a drive voltage output Step S22, and a jetting end command determination Step S24.

In the drive waveform acquisition Step S10, the head control unit 136 illustrated in FIG. 6 acquires the drive waveform via the drive waveform acquisition unit 138 illustrated in FIG. 5. The head control unit 136 stores the drive waveform in the image data memory 362. After the drive waveform acquisition Step S10, the processing proceeds to the transport velocity setting Step S12.

In the transport velocity setting Step S12, the transport velocity setting unit 142 sets the transport velocity of the paper P. The transport velocity setting unit 142 transmits the information on the transport velocity of the paper P to the jetting frequency setting unit 140. The jetting frequency setting unit 140 sets the jetting frequency on the basis of the information on the transport velocity of the paper P. The jetting frequency setting unit 140 transmits the information on the jetting frequency to the jetting timing control unit 365.

After the transport velocity setting Step S12, the processing proceeds to the drive voltage generation Step S14. The step of setting the jetting frequency in the transport velocity setting Step S12 described in the embodiment is an example of a jetting frequency setting step.

In the drive voltage generation Step S14, the drive voltage generation unit 380 generates the drive voltage using the drive waveform. After the drive voltage generation Step S14, the processing proceeds to the encoder signal input Step S16.

In the encoder signal input Step S16, the head control unit 136 acquires the output signal of the rotary encoder 15. After the encoder signal input Step S16, the processing proceeds to the start trigger signal generation Step S18.

In the start trigger signal generation Step S18, the jetting timing control unit 365 generates the start trigger signal by using the jetting frequency and an encoder signal based on the transport velocity of the paper P set in the transport velocity setting Step S12.

That is, the jetting frequency based on the transport velocity of the paper P set in the transport velocity setting Step S12 is a target jetting frequency. In a case where the fluctuation of the transport velocity of the paper P does not occur, the jetting frequency may be fixed. However, in practice, the transport velocity of the paper P has a variation, and the jetting timing needs to be adjusted in accordance with the variation in the transport velocity of the paper P.

In other words, in the start trigger signal generation Step S18, the start trigger signal to be applied to the adjustment of the jetting frequency according to the variation in the transport velocity of the paper P is generated. The actual jetting frequency is adjusted within a specified range with respect to a target value. After the start trigger signal generation Step S18, the processing proceeds to the start trigger signal output Step S20.

In the start trigger signal output Step S20, the jetting timing control unit 365 transmits the start trigger signal to the image data transmission control circuit 364 and the drive voltage control circuit 368. After the start trigger signal output Step S20, the processing proceeds to the drive voltage output Step S22.

In the drive voltage output Step S22, the drive voltage output unit outputs the drive voltage. The drive voltage is supplied from the head control unit 136 to the jetting head 21 via the first connector 394A and the second connector 394B. After the drive voltage output Step S22, the processing proceeds to a jetting end command determination Step S24. In addition, the drive voltage output Step S22 corresponds to an example of a drive voltage supply step.

In the jetting end command determination Step S24, the head control unit 136 determines whether or not a jetting end command has been acquired. Examples of a mode in which the jetting end command is acquired include a mode in which the jetting end command is acquired in a case where a print job is ended and a mode in which the jetting end command is acquired in a case where a print job accompanying abnormality occurrence or the like is stopped.

In a case where the head control unit 136 has not acquired the jetting end command in the jetting end command determination Step S24, No determination is made, and the respective steps from the encoder signal input Step S16 to the drive voltage output Step S22 are repeatedly performed until a Yes determination is made in the jetting end command determination Step S24.

On the other hand, in the jetting end command determination Step S24, in a case where the head control unit 136 acquires the jetting end command, a Yes determination is made, specified end processing is executed, and printing is ended.

[Description of Drive Waveform]

Figure 8:
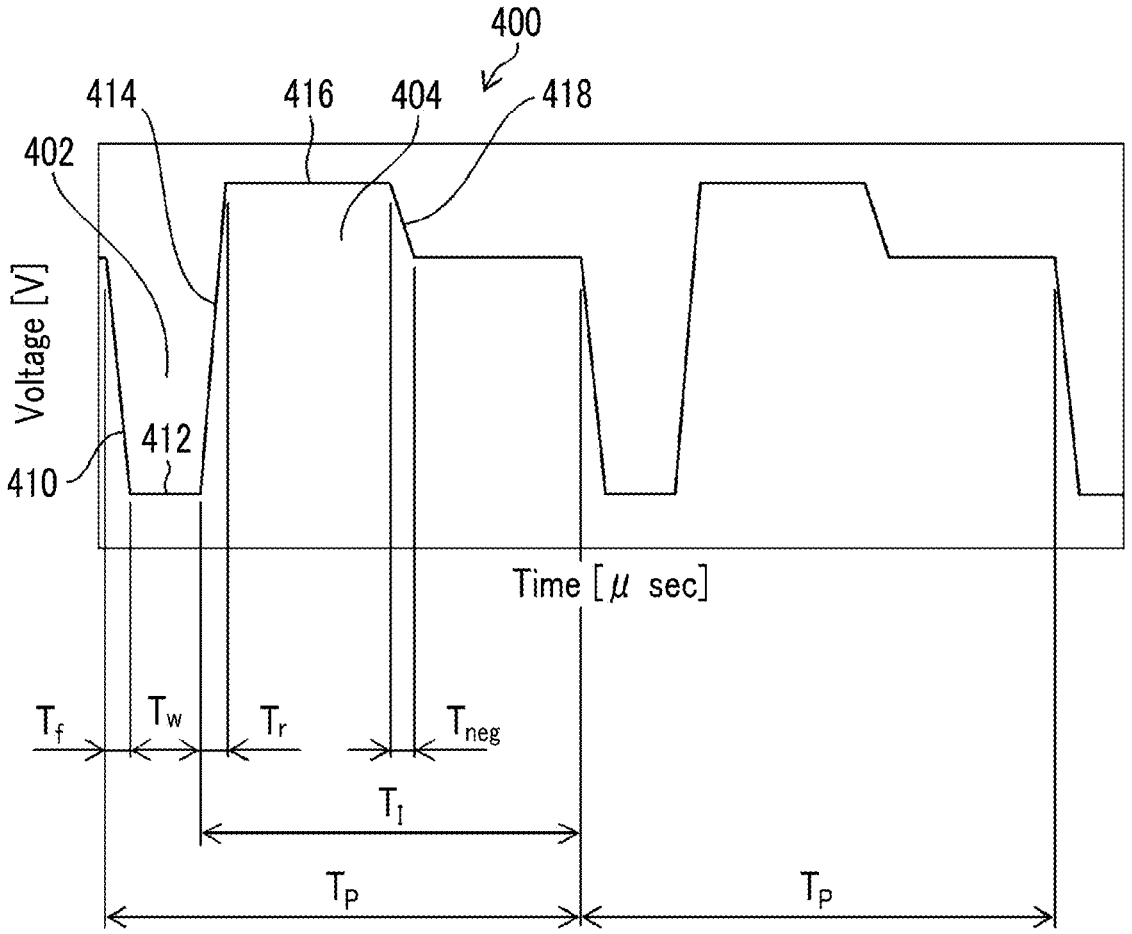
FIG. 8 is a view illustrating an example of a drive waveform.

FIG. 8 is a view illustrating an example of the drive waveform. FIG. 8 illustrates a drive waveform 400 by applying a graph format. A period is applied to a horizontal axis of FIG. 8. The unit of the period is microsecond. As a horizontal axis of FIG. 8, a voltage is applied. The unit of the voltage is volt. FIG. 8 illustrates the drive waveform 400 having a one-pixel cycle $T_P$ for a two-pixel cycle.

In addition, in the drive waveform 400 for the two-pixel cycle illustrated in FIG. 8, a drive voltage generated from the drive waveform 400 corresponding to a preceding droplet is an example of a first drive voltage. Additionally, a drive voltage generated from the drive waveform 400 corresponding to a subsequent droplet is an example of a second drive voltage.

The drive waveform 400 includes a jetting waveform 402 and a reverberation suppression waveform 404. The jetting waveform 402 is a waveform that contributes to the ink jetting. The reverberation suppression waveform 404 is a waveform that contributes to the suppression of vibration of the ink after the ink jetting. In addition, the drive waveform 400 described in the embodiment is an example of the drive waveform including one or more jetting waveforms.

The jetting waveform 402 includes a first waveform element 410, a second waveform element 412, and a third waveform element 414. The first waveform element 410 is a waveform element that expands the pressure chamber 72 in a statically determinate state. The second waveform element 412 is a waveform element that maintains the expanded state of the pressure chamber 72. The third waveform element 414 is a waveform element that contracts the expanded pressure chamber 72.

A reference sign $T_f$ represents a pull period. The pull period $T_f$ is a period during which the first waveform element 410 is applied to the piezoelectric element 74. A reference sign $T_r$ represents a push period. The push period $T_r$ is a period during which the third waveform element 414 is applied to the piezoelectric element 74.

A reference sign $T_w$ represents the width of the jetting waveform 402. There may be a case where the width of the jetting waveform 402 is referred to as a pulse width. The width $T_w$ of the jetting waveform 402 is a period from an end timing of the pull period $T_f$ to a start timing of the push period $T_r$.

The reverberation suppression waveform 404 includes a fourth waveform element 416 and a fifth waveform element 418. The fourth waveform element 416 is a waveform element that maintains a state in which the pressure chamber 72 is contracted rather than the statically determinate state. The fifth waveform element 418 is a waveform element that returns the pressure chamber 72 to the statically determinate state. The period of the fifth waveform element 418 is a reverberation canceling period $T_{neg}$ in which reverberation is cancelled.

In addition, the statically determinate state of the pressure chamber 72 is the state of the pressure chamber 72 in a case where the pressure chamber 72 is not jetted. The statically determinate state of the pressure chamber 72 may be realized by not applying a voltage to the piezoelectric element 74, or may be realized by applying a constant voltage to the piezoelectric element 74. The pressure chamber 72 illustrated in the embodiment is an example of a liquid chamber.

A pixel cycle $T_P$ represents a period from the start timing of the pull period $T_f$ in the drive waveform 400 of interest to the start timing of the pull period $T_f$ in the next drive waveform 400. The reciprocal of the pixel cycle is the jetting frequency.

A reference sign $T_1$ illustrated in FIG. 8 represents a period from the start timing of the push period $T_r$ of the jetting waveform 402 to the end timing of the jetting waveform 402. In addition, the end timing of the jetting waveform 402 coincides with the start timing of the jetting waveform 402 in the next pixel cycle $T_p$. The period $T_1$ is defined using a resonant cycle $T_c$. The details of the period $T_1$ will be described below.

FIG. 8 illustrates the drive waveform 400 including one jetting waveform 402, but the drive waveform 400 may include a plurality of jetting waveforms 402. In the drive waveform 400 including the plurality of jetting waveforms 402, one or more jetting waveforms 402 may be appropriately selected from the plurality of jetting waveforms 402 to realize two or more types of liquid droplet sizes.

[Detailed Description of Challenge]

In the drive waveform 400 within the one-pixel cycle, a technique of efficiently ensuring the liquid droplet amounts and applying the reverberation suppression waveform 404 as a final waveform of the drive waveform 400 within the one-pixel cycle to positively reduce the vibration of the ink inside the pressure chamber 72 till the time immediately before the application of the jetting waveform 402 in the next pixel cycle may be used in combination with a method of applying resonance to the pulse width and pulse interval to realize jetting.

However, the ink vibration cannot be completely canceled by simply applying the reverberation suppression waveform 404, and the jetted liquid droplets are accelerated or decelerated depending on the start timing of the next pixel cycle.

Particularly, in a case where the liquid droplets are accelerated, the amplitude of the meniscus increases, and an increase in abnormal nozzles is observed during continuous printing.

In addition, the continuous printing refers to printing that is continuously performed on two or more sheets of paper P. For the continuous printing, the same image data may be applied, or different image data may be applied. A specified interval may be set during printing to each sheet of paper P.

On the other hand, lengthening the period for suppressing the reverberation can realize stable jetting. However, this may directly lead to a decrease in printing velocity. It is necessary to minimize the decrease in printing velocity. As the printing velocity, the number of printed sheets per unit time may be applied.

Here, Paragraph <0047> of WO2012/081472A describes that, in a case where the half cycle of the natural vibration cycle of the pressure chamber is set as AL, as the periods for suppressing the reverberation, a period from a jetting pulse P1 to a cancel pulse C1 is set as 2×AL, a period of the cancel pulse C1 is set AL, and a period from the cancel pulse C1 to a jetting pulse P2 is set as 5×AL. That is, in the invention described in WO2012/081472A, a period for suppressing the reverberation is set as 8×AL.

From a graph such as FIG. 9A, it can be read that the condition of the jetting frequency at which the jetting velocity of liquid droplets caused by the jetting pulse P2 does not become slower than the jetting velocity of liquid droplets caused by the jetting pulse P1 is 20 kHz or less in practice. In Paragraph <0048> of the same document, AL is described as 3.3 microseconds. On the basis of these numerical values, the period from the end timing of the jetting pulse P1 to the start timing of the jetting pulse P2 is calculated to be 40.6 microseconds. 40.6 microseconds is a numerical value between 12×AL and 13×AL.

That is, WO2012/081472A discloses conditions for realizing stable jetting by using the cancel pulse C1, but does not disclose that the decrease in printing velocity is minimized. In other words, WO2012/081472A discloses that stable jetting is realized by sets a period from the end timing of a jetting pulse in a first cycle to the start timing of a jetting pulse in a second cycle to be ten times or more the half cycle AL of the natural vibration cycle of the pressure chamber.

In the head drive method according to the present embodiment, a jetting frequency capable of realizing efficient liquid droplet jetting by using the resonance for the drive waveform of a one-pixel cycle and realizing stable liquid droplet jetting even during the continuous printing is applied.

[Description of Jetting Frequency]

In the continuous jetting to which the drive waveform using the resonance is applied, a jetting frequency in which the subsequent droplet is not accelerated with respect to the preceding droplet is applied to the preceding droplet and the subsequent droplet jetted after the one-pixel cycle of the preceding drop. The drive waveform using the resonance is a drive waveform in which the pulse width of the jetting waveform is $T_c/2$, which is a half cycle of $T_c$ of the resonant cycle.

The resonant cycle $T_c$ is the Helmholtz natural vibration cycle of the jetting head 21. The resonant cycle $T_c$ is the natural cycle of the entire vibration system determined from the structure of an ink flow channel, the physical property value of the ink as an acoustic element, the physical property value of a piezoelectric element, and the like. The resonant cycle $T_c$ may be calculated by calculation from the design value of a jetting head. The design value of the jetting head includes the physical property value of the ink used.

The derivation of the resonant cycle $T_c$ is not limited to the method of estimating from the design value of the jetting head, and a method of performing an experiment to perform measurement may be applied. For example, the resonant cycle $T_c$ can be grasped by using a simple square wave as the drive waveform to gradually change the pulse width of a square wave to investigate the drop velocity and the liquid droplet amount. In addition, the term velocity in the present specification may be used to mean velocity, which is an absolute value of velocity.

Figure 9:
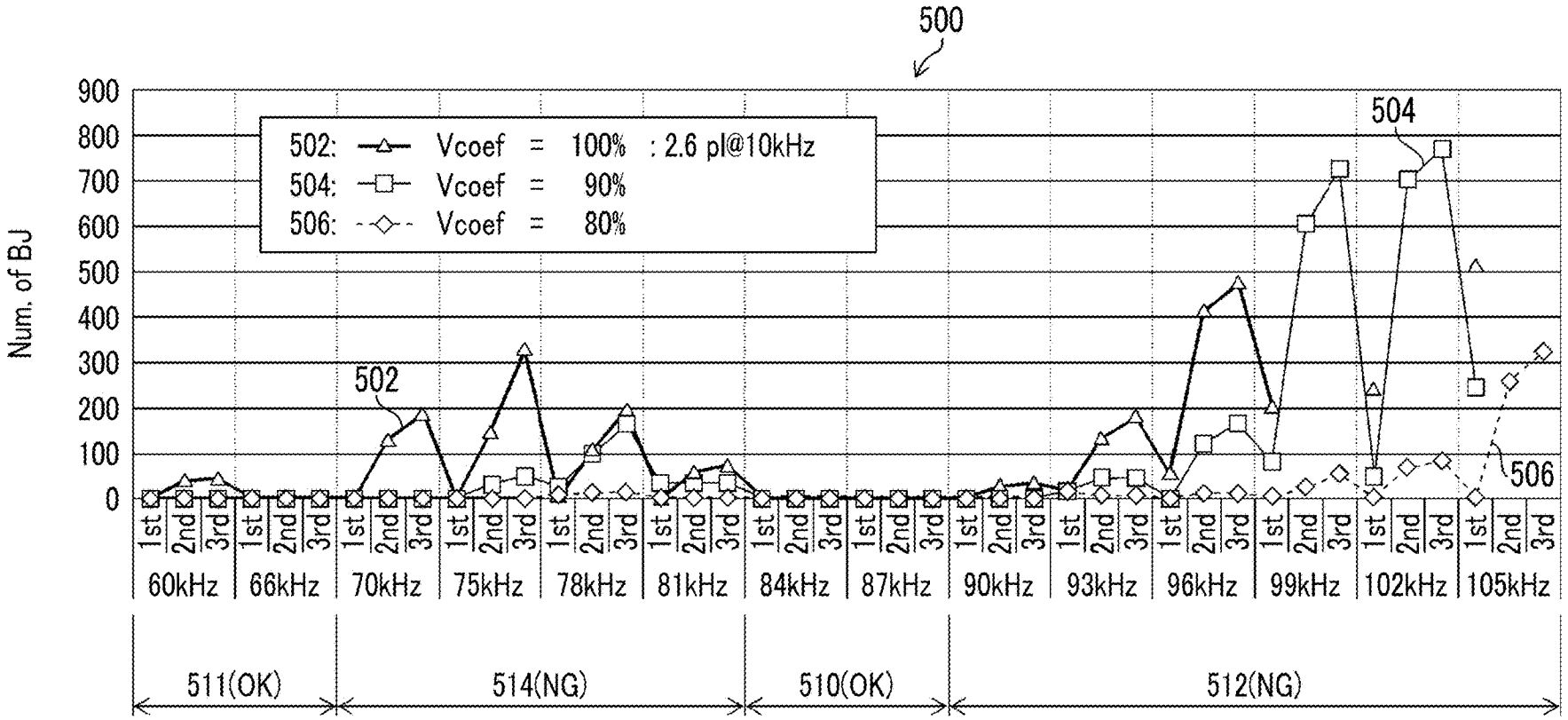
FIG. 9 is a graph illustrating continuous jetting performance in a case where a single-shot drive waveform is applied.

FIG. 9 is a graph illustrating continuous jetting performance in a case where a single-shot drive waveform is applied. The term "single-shot" represents jetting using a drive waveform in which one jetting waveform is included in the one-pixel cycle. Jetting using a drive waveform in which a plurality of jetting waveforms are included in the one-pixel cycle is referred to as a continuous shot.

FIG. 9 illustrates a graph 500 illustrating a relationship between the jetting frequency and the number of jetting abnormalities. The jetting frequency is applied to a horizontal axis of the graph 500. As the unit of the horizontal axis, kHz is applied. The number of nozzles of which the jetting state has deteriorated is applied to a vertical axis of the graph 500. As the unit of the number of jetting abnormalities, pieces are applied.

Graph 500 is created through the following procedure. First, jetting is performed from all nozzles of the jetting head using a single-shot drive waveform. As the single-shot drive waveform, the drive waveform including the jetting waveform 402 illustrated in FIG. 8 is applied.

The jetting frequency is sequentially changed from 60 kHz to 105 kHz, and the continuous jetting using the single-shot drive waveform is performed for each nozzle 25 to form any pattern to measure a landing position error on the paper P. A 1-on-M-off pattern may be applied as any pattern for measuring the landing position error. In addition, M is an integer of 2 or more. Pattern printing to the paper P is continuously performed on a plurality of sheets of paper P.

Next, the landing position deviation for each nozzle is measured for 1st, 150th, and 300th sheets of paper P. As the measurement of the landing position deviation, a known measurement method may be applied. A nozzle of which the measurement value of the landing position deviation exceeds a reference is determined to be a nozzle of which the jetting state has deteriorated. The number of nozzles of which the jetting state has deteriorated for each jetting frequency is plotted. 1st represents a measurement result of the first sheet of paper P. 2nd represents a measurement result of the 150th sheet of paper P. 3rd represents a measurement result of the 300th sheet of paper P.

A curve 502 represents a measurement result in a case where the drive voltage of a reference amplitude is used. A curve 504 represents a measurement result in a case where the amplitude of the drive voltage is 90 percent of the reference amplitude. A curve 506 represents a measurement result in a case where the amplitude of the drive voltage is 80 percent of the reference amplitude. The drive voltage to which the reference amplitude is applied is specified from the conditions for jetting 2.6 picoliters of liquid droplets in a case where the jetting frequency is 10 kHz.

A jetting head and ink used in experiments performed in a case where the graph 500 is created are as shown in Table 1. The paper P used in the experiments performed in a case where the graph 500 is created is an ink-jet coated paper.

TABLE 1

| | | |
|---|---|---|
| Ink Jet Head | samba G3L | Made by FUJIFILM |
| Ink | C-WP-QK | Made by FUJIFILM |

In the graph 500, in all of the curves 502, 504, and 506, the bands of the jetting frequency in which the number of nozzles of which the jetting state has deteriorated is 50 or less are a recommended jetting frequency band 510 and a recommended jetting frequency band 511. On the other hand, in any of the curves 502, 504, and 506, the bands of the jetting frequency in which the number of nozzles of which the jetting state has deteriorated exceeds 50 are a non-recommended jetting frequency band 512 and a non-recommended jetting frequency band 514.

The curves 502, 504, and 506 show that the number of nozzles of which the jetting state has deteriorated tends to decrease in a case where the amplitude of the drive voltage is relatively small. That is, the drop velocity increases relatively in a case where the amplitude of the drive voltage is relatively large, while the jetting state tends to deteriorate in a case where the drop velocity is too fast.

On the other hand, in a case where the amplitude of the drive voltage is relatively small, the drop velocity may be relatively small, while the liquid droplet amount in one jetting may decrease relatively. It is not preferable to make the amplitude of the drive voltage relatively small for the purpose of suppressing the deterioration of the jetting state from the viewpoint of ensuring the specified liquid droplet amount. Thus, in order to ensure the specified liquid droplet amount and the stability of the continuous jetting, it is recommended to select any jetting frequency in the recommended jetting frequency band 510 and the recommended jetting frequency band 511.

Figure 10:
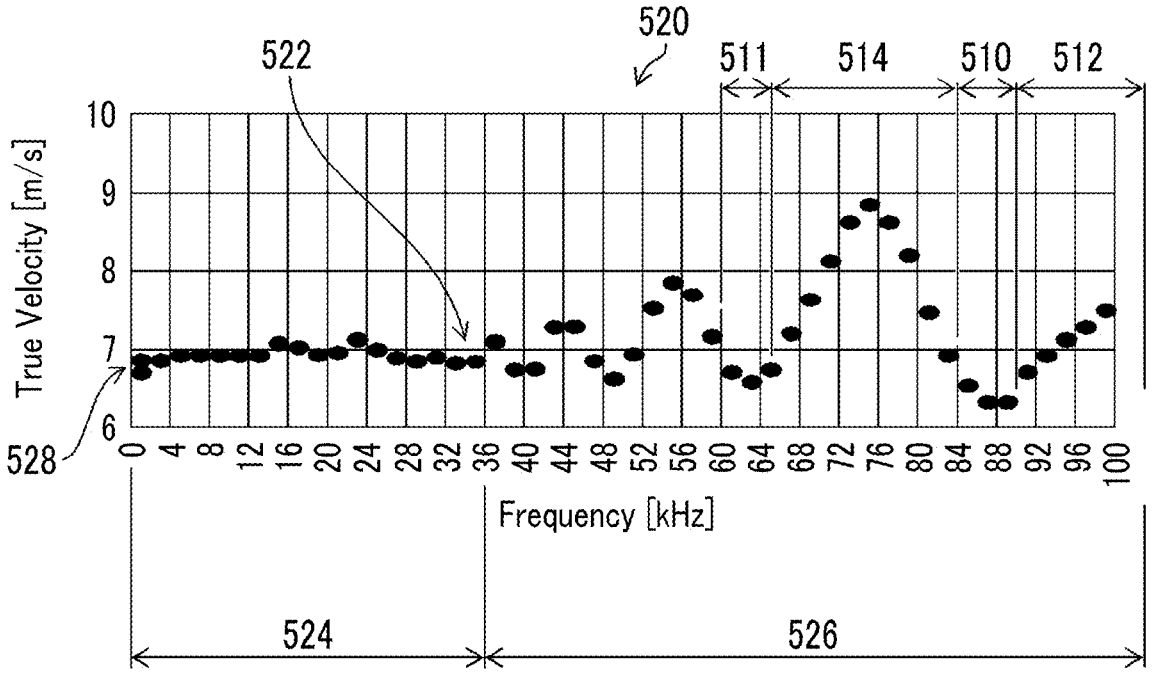
FIG. 10 is a graph illustrating a relationship between jetting frequency and drop velocity in a case where the single-shot drive waveform is applied.

FIG. 10 is a graph illustrating a relationship between the jetting frequency and the drop velocity in a case where the single-shot drive waveform is applied. The jetting frequency is applied to a horizontal axis of the graph 520. As the unit of the horizontal axis, kHz is applied. The drop velocity is applied to a vertical axis of graph 520. As the unit of the drop velocity, meter per second is applied.

In FIG. 10, the recommended jetting frequency band 510, the recommended jetting frequency band 511, the non-recommended jetting frequency band 512, and the non-recommended jetting frequency band 514 illustrated in FIG. 9 are overlappingly illustrated on the graph 520. In addition, a relationship between the jetting frequency and the drop velocity illustrated in FIG. 10 is an example of drop velocity information.

A procedure for deriving the drop velocity is as follows. A position where the distance of the jetting head 21 from the nozzle surface 24 is 300 micrometers is defined as a first measurement position. A position where the distance of the jetting head 21 from the nozzle surface 24 is 500 micrometers is defined as a second measurement position.

A period required for a liquid droplet to move from the first measurement position to the second measurement position is measured. A known method is applied to measure the movement period of the liquid droplet. The continuous jetting is performed for each jetting frequency, multiple measurements were performed, and an average value of multiple measurement values is taken as a measurement result for each jetting frequency. The drop velocity is calculated by dividing the distance from the first measurement value to the second measurement position by the measurement value of the period.

The jetting head 21 and the ink used for measuring the movement period of a liquid droplet are as shown in Table 1. As the drive voltage, the drive voltage of the reference amplitude is applied. The liquid droplet amount is 2.6 picoliters in a case where the jetting frequency is 10 kHz.

Ae jetting frequency band in which the drop velocity is constant on the curve 522 illustrated in FIG. 10 is defined as a first jetting frequency band 524. The drop velocity in the first jetting frequency band 524 is defined as a reference drop velocity 528. In addition, the reference drop velocity 528 described in the embodiment is an example of a first velocity.

As the jetting frequency band in which the drop velocity is constant, a jetting frequency band in which the drop velocity does not change periodically may be applied. For example, in the graph 520 illustrated in FIG. 10, a jetting frequency band having a jetting frequency from 0 kilohertz to 14 kHz is included in the first jetting frequency band 524.

Additionally, the first jetting frequency band 524 may include a jetting frequency band in which the drop velocity changes periodically, but the difference from the reference drop velocity 528 is within a specified range. The specified range may be specified using the ratio of the drop velocity to a maximum amplitude. For example, the ratio of the drop velocity to the maximum amplitude may be 10 percent or less. In graph 520 illustrated in FIG. 10, a frequency band having a jetting frequency of more than 14 kHz and 36 kHz or less may be included in the first jetting frequency band 524.

A jetting frequency band in which the drop velocity changes periodically and the difference from the reference drop velocity 528 exceeds the specified range is defined as a second jetting frequency band 526. For example, a jetting frequency band having a jetting frequency of more than 36 kHz and 105 kHz or less is included in the second jetting frequency band 526.

The recommended jetting frequency band 510 in the graph 500 illustrated in FIG. 9 is a jetting frequency band in which the drop velocity is the reference drop velocity 528 or less and the inclination of the curve 522 is 0 or less, in the graph 520 illustrated in FIG. 10. Additionally, the recommended jetting frequency band 511 in the graph 500 illustrated in FIG. 9 is a frequency band in which the drop velocity is the reference drop velocity 528 or less, in the graph 520 illustrated in FIG. 10.

In the recommended jetting frequency band 510 illustrated in FIG. 10, 86 kHz, which is a minimum value of the curve 522, may be set as the jetting frequency. Similarly, in the recommended jetting frequency band 511, 62 kHz, which is a minimum value of the curve 522, may be set as the jetting frequency. Accordingly, it is possible to make the drop velocity of a subsequent droplet slowest.

Here, the drop velocity illustrated in FIG. 10 will be described. In a case where any jetting frequency in the second jetting frequency band 526 is set, the first jetting is not affected by the resonance. That is, it is considered that a liquid droplet in the first jetting behaves in the same manner as in a case where any jetting frequency in the first jetting frequency band 524 is set. Then, as the drop velocity of the preceding droplet in the continuous jetting, a drop velocity corresponding to the optional jetting frequency in the first jetting frequency band 524 may be applied.

The second jetting is affected by the first jetting, and the drop velocity fluctuates with respect to the drop velocity in the first jetting. The third jetting is affected by the second jetting, and the drop velocity fluctuates with respect to the drop velocity at the second jetting. In this way, the subsequent droplet is gradually brought into a steady state while being influenced by the preceding droplet. The drop velocity graph 520 illustrated in FIG. 10 represents drop velocity in the steady state of the subsequent droplets in the continuous jetting.

In other words, the drop velocity illustrated in FIG. 10 can be said to represent the drop velocity of the subsequent droplet affected by the preceding droplet for each jetting frequency. Also, it can be said that a jetting frequency band in which the drop velocity is smaller than the drop velocity corresponding to the optional jetting frequency in the first jetting frequency band 524 satisfies the conditions that the subsequent droplet is not accelerated with respect to the preceding droplet.

The control device 100 illustrated in FIG. 5 may store the drop velocity information, which is the relationship between the jetting frequency and the drop velocity in a case where the single-shot drive voltage measured using the jetting head 21 is applied, and may set the jetting frequency on the basis of the drop velocity information using the jetting frequency setting unit 140. Additionally, the control device 100 may store at least one of the recommended jetting frequency band 510 and the recommended jetting frequency band 511 extracted from the drop velocity information, and may store the jetting frequency on the basis of the recommended jetting frequency band 510 or the recommended jetting frequency band 511 by using the jetting frequency setting unit 140.

In addition, a drop velocity, which corresponds to the recommended jetting frequency band 510 or the recommended jetting frequency band 511 illustrated in the embodiment and is the reference drop velocity 528 or less, is an example of a second velocity. Additionally, the reference drop velocity 528 or less illustrated in the embodiment is an example of ae first velocity or less.

In the present embodiment, the drop velocity information to which the single-shot drive waveform is applied is exemplified, but drop velocity information to which a continuous-shot drive waveform is applied may be used. That is, drop velocity information to which a drive waveform including one or more jetting waveforms is applied to the pixel cycle may be used.

[Drive Waveform that Satisfies Condition that Subsequent Droplet is not Accelerated with Respect to Preceding Droplet]

In the drive waveform 400 in the one-pixel cycle $T_P$ illustrated in FIG. 8, in a case where n is set to 1 or 2, the period $T_1$ from the start timing of the push period $T_r$ in the jetting waveform 402 to the end timing of the drive waveform 400 satisfies Expression 1.

$$n \times T_c \leq T_1 \leq (n+1/2) \times T_c \qquad \text{Expression 1}$$

That is, in the case of n=1, any value from twice the half cycle of the resonant cycle $T_c$ to three times the half cycle of the resonant cycle $T_c$ is applied to the period $T_1$. Additionally, in the case of n=2, any value from four times the half cycle of the resonant cycle $T_c$ to five times the half cycle of the resonant cycle $T_c$ is applied to the period $T_1$.

Expression 1 corresponds to a jetting frequency band in which the drop velocity is the reference drop velocity 528 or less in the curve 522 illustrated in FIG. 10.

In addition, the period $T_1$ from the start timing of the push period $T_r$ in the jetting waveform 402 to the end timing of the drive waveform 400 is an example of the period $T_1$ from a start point of a final waveform element in a first drive waveform to a start point of a first waveform element in a second drive waveform corresponding to the next pixel cycle of the first drive waveform.

Additionally, in the drive waveform 400 in the one-pixel cycle $T_P$ illustrated in FIG. 8, in a case where n is set to 1 or 2, the period $T_1$ from the start timing of the push period $T_r$ in the jetting waveform 402 to the end timing of the drive waveform 400 satisfies Expression 2.

$$(N+1/4) \times T_c \leq T_1 \leq (n+1/2) \times T_c \qquad \text{Expression 2}$$

That is, in the case of n=1, any value from five times the quarter cycle of the resonant cycle $T_c$ to six times the quarter cycle of the resonant cycle $T_c$ is applied to the period $T_1$ Additionally, in the case of n=2, any value from nine times the quarter cycle of the resonant cycle $T_c$ to ten times the quarter cycle the resonant cycle $T_c$ is applied to the period $T_1$.

In other words, in the case of n=1, any value from 2.5 times the half cycle of the resonant cycle $T_c$ to three times the half cycle of the resonant cycle $T_c$ is applied to the period $T_1$. In the case of n=2, any value from 4.5 times the half cycle of the resonant cycle $T_c$ to five times the half cycle of the resonant cycle $T_c$ is applied to the period $T_1$.

Expression 2 corresponds to a jetting frequency band in which the drop velocity is the reference drop velocity 528 and the inclination of the curve 522 is 0 or less, in the curve 522 illustrated in FIG. 10.

Figure 11:
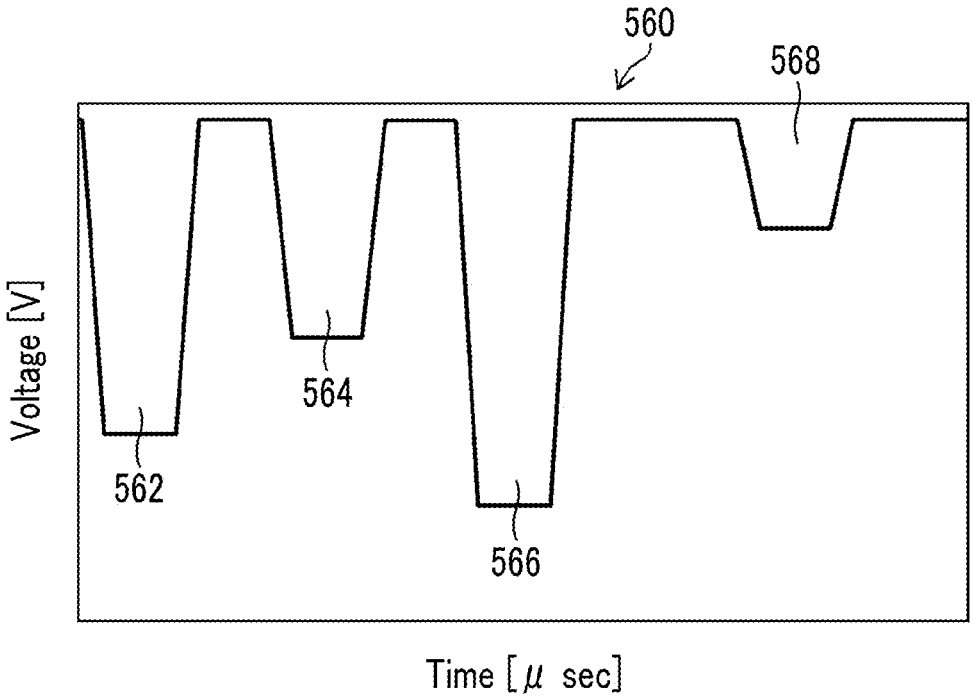
FIG. 11 is a view illustrating a configuration example of a continuous-shot drive waveform.
Figure 15:
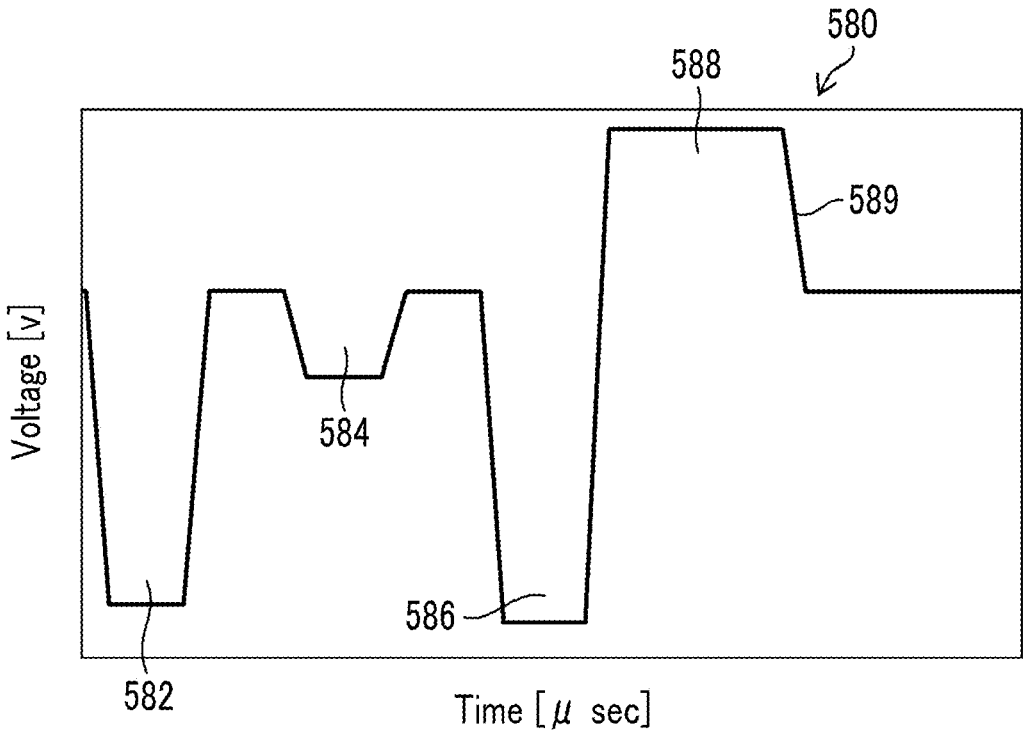
FIG. 15 is a view illustrating another configuration example of a multi-pulse drive waveform.

In the case of the continuous-shot drive waveform illustrated in FIGS. 11 and 15, the period $T_1$ may be a period from the start timing of the push period $T_r$ in a final jetting pulse to the end timing of the drive waveform 400.

The jetting frequency setting unit 140 illustrated in FIG. 5 sets a target value of the jetting frequency that satisfies the period $T_1$ of Expression 1 or Expression 2 in accordance with a set value of the transport velocity of the paper P. The head control unit 136 adjusts the jetting timing on the basis of the output signal of the rotary encoder 15. That is, the jetting frequency is adjusted in accordance with the variation in the transport velocity of the paper P. In order to realize a highly accurate adjustment of the jetting timing, the paper transport unit 10 is configured to be capable of performing the transport of the paper P with high accuracy.

In addition, the rotary encoder 15 illustrated in the embodiment is an example of a component of a medium velocity information acquisition unit that acquires medium velocity information represent the movement velocity of the medium. A linear scale or the like may be applied instead of the rotary encoder 15. Additionally, the head control unit 136 illustrated in the embodiment is an example of a jetting frequency adjusting unit.

[Description of Recommended Jetting Frequency Band in a Case where the Continuous-Shot Drive Waveform is Applied]

Next, the recommended jetting frequency band in a case where the continuous-shot drive waveform is applied will be described. FIG. 11 is a view illustrating a configuration example of the continuous-shot drive waveform. There may be a case where the continuous-shot drive waveform is referred to as multi-pulse or the like.

FIG. 11 illustrates a drive waveform 560 obtained by applying a graph format. A period is applied to a horizontal axis of FIG. 11. The unit of the period is microsecond. A voltage is applied to a vertical axis of FIG. 11. The unit of the voltage is volt.

The drive waveform 560 illustrated in FIG. 11 includes a first jetting waveform 562, a second jetting waveform 564, a third jetting waveform 566, and a first reverberation suppression waveform 568. The first jetting waveform 562, the second jetting waveform 564, and the third jetting waveform 566 are selected in accordance with the size of a liquid droplet.

For example, in a case where a small droplet is jetted, the third jetting waveform 566 and the first reverberation suppression waveform 568 are combined together. In a case where a medium droplet is jetted, the first jetting waveform 562, the third jetting waveform 566, and the first reverberation suppression waveform 568 are combined together. In a case where a large droplet is jetted, the first jetting waveform 562, the second jetting waveform 564, the third jetting waveform 566, and the first reverberation suppression waveform 568 are combined together. In addition, the first reverberation suppression waveform 568 may be omitted for each droplet type.

The drive waveform 560 illustrated in FIG. 11 is an example of a drive waveform including a non jetting waveform discontinuous with a final waveform element in a final jetting waveform. The third jetting waveform 566 is an example of the final jetting waveform. A rising waveform element of the third jetting waveform 566 is an example of the final waveform element. The first reverberation suppression waveform 568 is an example of the non jetting waveform.

Figure 12:
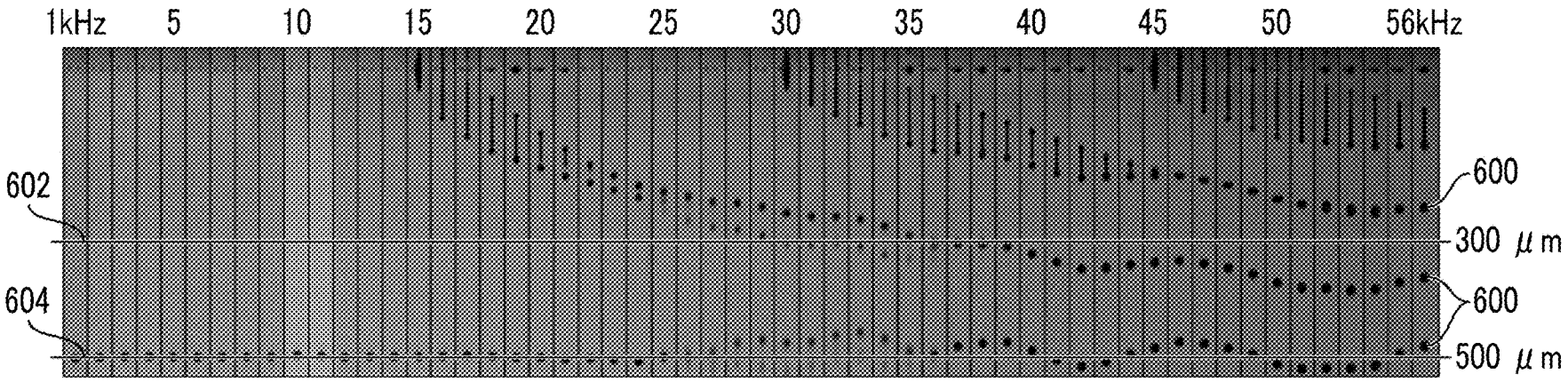
FIG. 12 is a view illustrating states of small droplets for each jetting frequency in a case where the drive waveform illustrated in FIG. 11 is applied.
Figure 13:
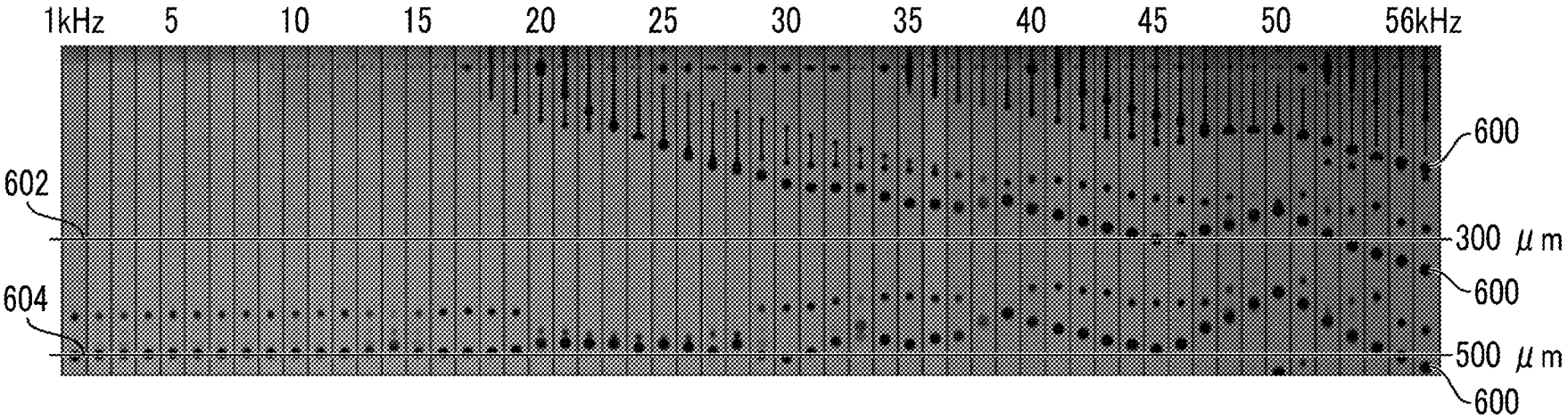
FIG. 13 is a view illustrating states of medium droplets for each jetting frequency in a case where the drive waveform illustrated in FIG. 11 is applied.
Figure 14:
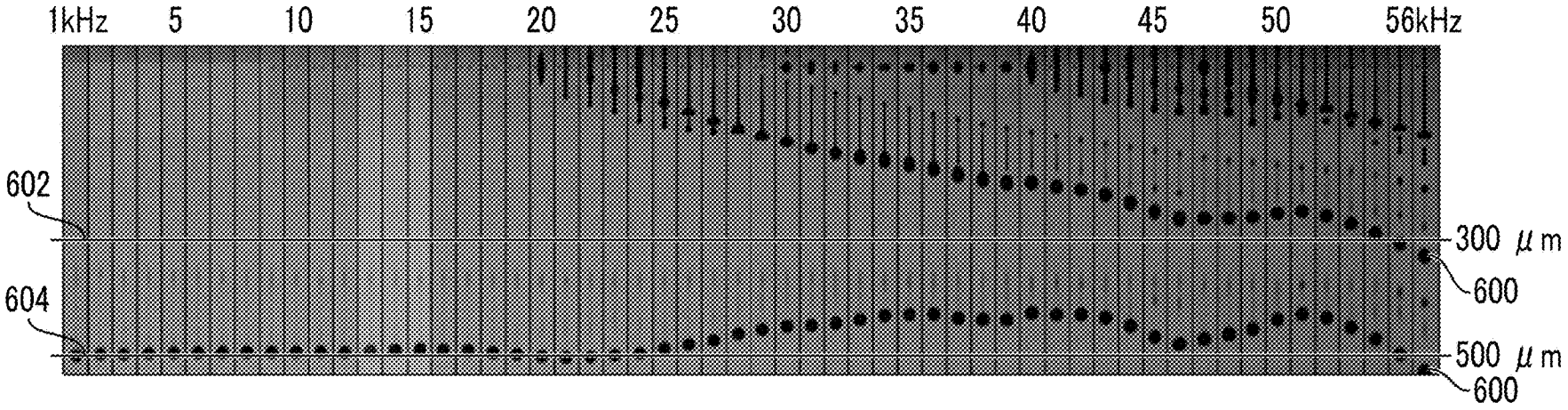
FIG. 14 is a view illustrating states of large droplets for each jetting frequency in a case where the drive waveform illustrated in FIG. 11 is applied.

FIG. 12 is a view illustrating states of small droplets for each jetting frequency in a case where the drive waveform illustrated in FIG. 11 is applied. FIG. 13 is a view illustrating states of medium droplets for each jetting frequency in a case where the drive waveform illustrated in FIG. 11 is applied. FIG. 14 is a view illustrating states of large droplets for each jetting frequency in a case where the drive waveform illustrated in FIG. 11 is applied.

FIGS. 12 to 14 were created by continuously imaging liquid droplets 600 jetted from a nozzle for each jetting frequency and arranging photographs for each jetting frequency from left to right along a horizontal series in order of jetting frequencies. A straight line with s reference sign 602 illustrated in FIGS. 12 to 14 represents a first position. A straight line with a reference sign 604 represents a second position 604.

A relationship between the drop velocity and the jetting frequency band of the small droplets illustrated in FIG. 12 and a relationship between the drop velocity and the jetting frequency band of the medium droplets illustrated in FIG. 13 are different from each other. Additionally, the relationship between the drop velocity and the jetting frequency band of the small droplets illustrated in FIG. 12 and a relationship between the drop velocity and the jetting frequency band of the large droplets illustrated in FIG. 14 are different from each other.

For example, in the case of the small droplets illustrated in FIG. 12, 53 kHz is the valley of the amplitude, whereas in the case of the medium droplets illustrated in FIG. 13, 56 kHz is the valley of the amplitude. Moreover, in the case of the large droplets illustrated in FIG. 14, the jetting frequency of 56 kHz or more is the valley of the amplitude. It is inferred that this is because, in the drive waveform 560 illustrated in FIG. 11, the start timing of the first reverberation suppression waveform 568 deviates from the end timing of the third jetting waveform 566 by a half period of the resonant cycle.

That is, in a case where a drive waveform shaving a different frequency characteristic in the drop velocity for each droplet type is applied as in the drive waveform 560 illustrated in FIG. 11, a jetting frequency that gives priority to a specific droplet type is set. Accordingly, in the specific droplet type, efficient liquid droplet jetting is realized by using the resonance for the drive waveform of the one-pixel cycle, and stable liquid droplet jetting is realized even during the continuous printing.

FIG. 15 is a view illustrating another configuration example of the multi-pulse drive waveform. A drive waveform 580 obtained by applying a graph format is illustrated in FIG. 15. A period is applied to a horizontal axis of FIG. 15. The unit of the period is microsecond. A voltage is applied to a vertical axis of FIG. 15. The unit of the voltage is volt.

The drive waveform 580 illustrated in FIG. 15 includes a fourth jetting waveform 582, a fifth jetting waveform 584, a sixth jetting waveform 586, and a second reverberation suppression waveform 588. The fourth jetting waveform 582, the fifth jetting waveform 584, and the sixth jetting waveform 586 are selected in accordance with the size of a liquid droplet.

For example, in a case where a small droplet is jetted, the sixth jetting waveform 586 and the second reverberation suppression waveform 588 are combined together. In a case where a medium droplet is jetted, the fourth jetting waveform 582, the sixth jetting waveform 586, and the second reverberation suppression waveform 588 are combined together. In a case where a large droplet is jetted, the fourth jetting waveform 582, the fifth jetting waveform 584, the sixth jetting waveform 586, and the second reverberation suppression waveform 588 are combined together. In addition, the second reverberation suppression waveform 588 may be omitted for each droplet type.

The drive waveform 580 illustrated in FIG. 15 is an example of a drive waveform including a final waveform element in a final jetting waveform and a continuous non-jetting waveform. The sixth jetting waveform 586 is an example of the final jetting waveform. A rising waveform element of the sixth jetting waveform 586 is an example of the final waveform element. The second reverberation suppression waveform 588 is an example of the non jetting waveform.

Figure 16:
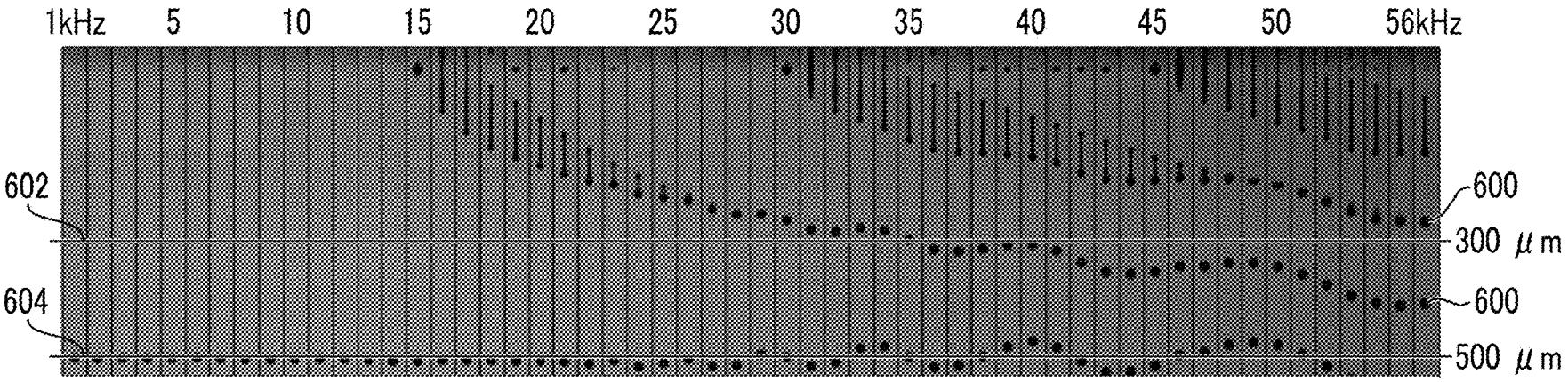
FIG. 16 is a view illustrating states of small droplets for each jetting frequency in a case where the drive waveform illustrated in FIG. 15 is applied.
Figure 17:
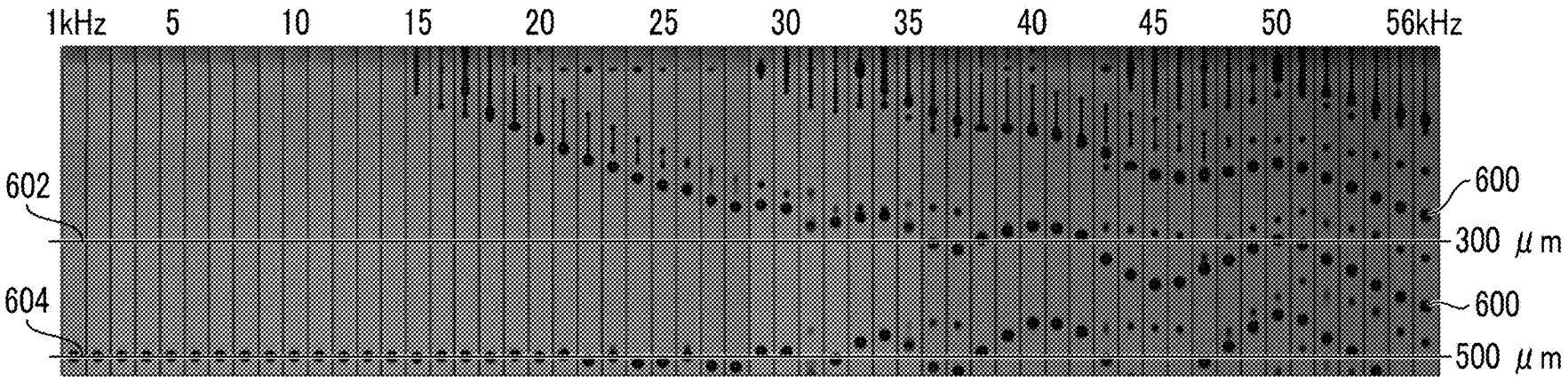
FIG. 17 is a view illustrating states of medium droplets for each jetting frequency in a case where the drive waveform illustrated in FIG. 15 is applied.
Figure 18:
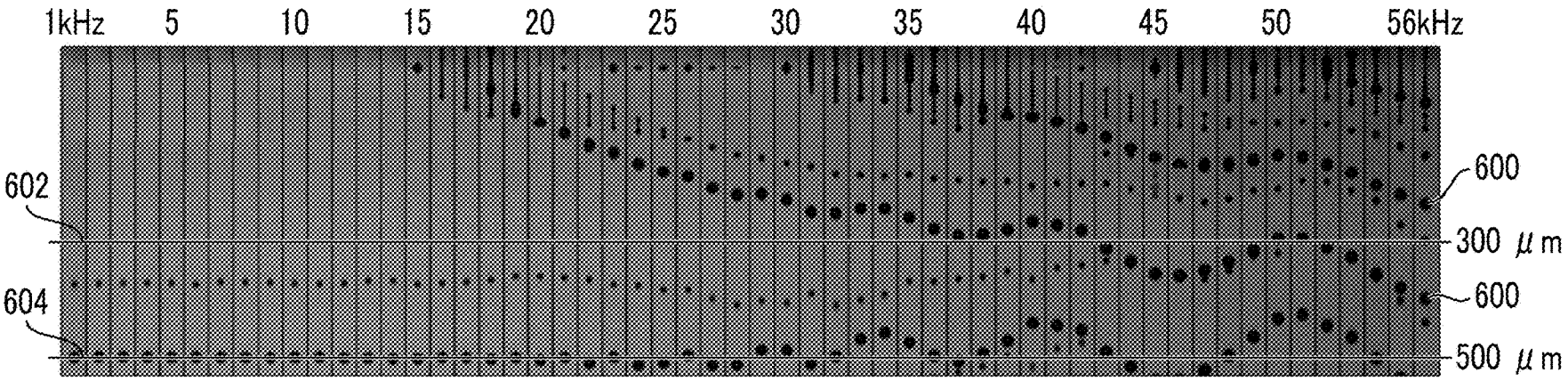
FIG. 18 is a view illustrating states of large droplets for each jetting frequency in a case where the drive waveform illustrated in FIG. 15 is applied.

FIG. 16 is a view illustrating states of small droplets for each jetting frequency in a case where the drive waveform illustrated in FIG. 15 is applied. FIG. 17 is a view illustrating states of medium droplets for each jetting frequency in a case where the drive waveform illustrated in FIG. 15 is applied. FIG. 18 is a view illustrating states of large droplets for each jetting frequency in a case where the drive waveform illustrated in FIG. 15 is applied.

A relationship between the drop velocity and the jetting frequency band of the small droplets illustrated in FIG. 16 and a relationship between the drop velocity and the jetting frequency band of the medium droplets illustrated in FIG. 17 substantially coincide with each other. Additionally, the relationship between the drop velocity and the jetting frequency band of the small droplets illustrated in FIG. 16 and a relationship between the drop velocity and the jetting frequency band of the large droplets illustrated in FIG. 18 substantially coincide with each other.

For example, all in the case of the small droplets illustrated in FIG. 16, in the case of the medium droplets illustrated in FIG. 17, and in the case of the large droplets illustrated in FIG. 18, the peaks of the amplitude substantially coincide with each other and the valleys of the amplitude substantially coincide with each other. This is because the start timing of the second reverberation suppression waveform 588 is made to coincides with the end timing of the sixth jetting waveform 586 and a pull waveform element 589 in the second reverberation suppression waveform 588 contributes to reverberation suppression.

That is, in a case where a drive waveform in which the frequency characteristics of the drop velocity substantially coincide with each other for each droplet type is applied as in the drive waveform 560 illustrated in FIG. 15, a jetting frequency common to respective droplet types is set. Accordingly, in each specific droplet type, efficient liquid droplet jetting is realized by using the resonance for the drive waveform of the one-pixel cycle, and stable liquid droplet jetting is realized even during the continuous printing.

The reason why the relationship between the drop velocity and the jetting frequency differs depending on the droplet type is a difference in the reverberation suppression method. Normally, refill vibration occurs from a timing when a liquid droplet has been jetted. In the reverberation suppression to which the second reverberation suppression waveform 588 illustrated in FIG. 15 is applied, a pressure chamber is changed in a depressurizing direction in a final stage of the sixth jetting waveform 586 to suppress the reverberation.

That is, the pressure chamber 72 is expanded at the timing when a liquid droplet is jetted. Accordingly, it is inferred that the start timing of the ink vibration in the refill coincides with the start timing of the refill. In other words, since the pressure chamber is expanded at the timing when the pressure chamber 72 is replenished with the ink, it is inferred that the piezoelectric element 74 operates to support the replenishment of the ink into the pressure chamber 72.

On the other hand, in the reverberation suppression to which the drive waveform 560 illustrated in FIG. 11 is applied, the pressure chamber 72 is changed in a pressurizing direction in a final stage of the first reverberation suppression waveform 568. That is, in the first reverberation suppression waveform 568, the pressure chamber 72 is contracted after the pressure chamber 72 is expanded. That is, the first reverberation suppression waveform 568 applies pressure in a direction in which the vibration of the ink in the refill is suppressed. As a result, it is inferred that a vibration different from the vibration of the ink in the refill is excited, or the refill is late and the pressure chamber 72 is in a depressurized state at the jetting timing. In addition, the depressurized state of the pressure chamber 72 represents a state in which the pressure chamber 72 is contracted with respect to the statically determinate state.

[Operational Effects]

According to the ink jet printing device 1 and the head drive method according to the present embodiment, the following operational effects can be obtained.

[1]

In the continuous jetting to which the drive waveform using the resonance is applied, the jetting frequency in which the subsequent droplet is not accelerated with respect to the preceding droplet is applied to the preceding droplet and the subsequent droplet jetted after the one-pixel cycle of the preceding drop. Accordingly, efficient liquid droplet jetting can be realized, and stable liquid droplet jetting can be realized even during the continuous printing.

[2]

In the drop velocity information showing the relationship between the jetting frequency and the drop velocity in a case where the single-shot drive voltage is applied, any jetting frequency in the jetting frequency band where the drop velocity is the reference drop velocity 528 or less that is the drop velocity in the first jetting frequency band 524 where the drop velocity is constant is set as the jetting frequency of the jetting head 21. Accordingly, as the jetting frequency of the jetting head 21, a jetting frequency in which the subsequent droplet is not accelerated with respect to the preceding droplet can be applied.

[3]

The period $T_1$ from the start timing of the push period $T_r$ of the final jetting pulse to the end timing of the drive waveform satisfies $n \times T_c \leq T_1 \leq (n+1/2) \times T_c$ in a case where n is 1 or 2. Accordingly, it is possible to shift the jetting timing of the subsequent droplet with respect to the vibration caused by the jetting of the preceding droplet.

[4]

any jetting frequency of the jetting frequency band where the drop velocity is the reference drop velocity 528 or less and the inclination in the curve 522 representing the drop velocity information 0 or less is set as the jetting frequency of the jetting head 21. Accordingly, in setting the jetting frequency of the jetting head 21, the conditions for decelerating the subsequent droplet with respect to the preceding droplet can be applied.

[5]

The period $T_1$ from the start timing of the push period $T_r$ of the final jetting pulse to the end timing of the drive waveform satisfies $(n+1/4) \times T_c \leq T_1 \leq (n+1/2) \times T_c$ in a case where n is 1 or 2. Accordingly, it is possible to shift the jetting timing of the subsequent droplet with respect to the vibration caused by the jetting of the preceding droplet.

any jetting frequency of the jetting frequency band corresponding to the minimum value of the curve 522 representing the drop velocity with respect to the jetting frequency is set as the jetting frequency of the jetting head 21. Accordingly, in setting the jetting frequency of the jetting head 21, the conditions that the drop velocity of the subsequent droplet is minimized can be applied.

[7]

The drive waveform 580 includes the second reverberation suppression waveform 588. The second reverberation suppression waveform 588 deviates from the end timing of the third jetting waveform 566 by a half period of the resonant cycle. The first reverberation suppression waveform 568 suppresses the reverberation by changing the pressure chamber in the depressurizing direction in the final stage of the sixth jetting waveform 586. Accordingly, in a case where two or more types of droplets are used, efficient liquid droplet jetting can be realized for all the droplet types, and stable liquid droplet jetting can be realized even during the continuous printing.

[Example of Application to Head Drive Device and Head Device]

The head control unit 136 illustrated in FIGS. 5 and 6 may constitute a head drive device that drives the jetting head 21. The head drive device may include the system control unit 102, the communication unit 104, the display control unit 114, and the like illustrated in FIG. 5. Additionally, the head drive device and the jetting head 21 may constitute a head device.

In the embodiment of the present invention described above, it is possible to appropriately change, add, or delete the configuration requirements without departing from the spirit of the present invention. The present invention is not limited to the embodiment described above, and many modifications can be made by a person having ordinary skill in the art within the technical idea of the present invention.

EXPLANATION OF REFERENCES

1: ink jet printing device

10: paper transport unit

11: belt
11A: paper support surface
12 drive roller
13: driven roller
14: motor
15: rotary encoder
16: suction unit
20: transport unit
21: jetting head
21C: jetting head
21K: jetting head
21M: jetting head
21Y: jetting head
22: head module
22A: first head module
22B: second head module
23: base frame
24: nozzle surface
25: nozzle
30: reading unit
31: in-line scanner
40: paper feed unit
41: paper feed tray
50: stacking unit
70: ejector
72: pressure chamber
74: piezoelectric element
76: nozzle flow channel
78: individual supply passage
80: supply-side common branch flow channel
82: vibration plate
84: individual electrode
86: piezoelectric body
88: cover plate
90: movable space
100: control device
102: system control unit
104: communication unit
105: host computer
106: image data acquisition unit
108: memory
110: program storage unit
114: display control unit
115: display device
116: operation control unit
117: operating device
118: image processing unit
120: correction processing unit
122: halftone processing unit
130: paper feed control unit
134: transport control unit
136: head control unit
138: drive waveform acquisition unit
140: jetting frequency setting unit
142: transport velocity setting unit
362: image data memory
364: image data transmission control circuit
365: jetting timing control unit
366: waveform data memory
368: drive voltage control circuit
377A: first power amplifier circuit
377B: second power amplifier circuit
379A: first digital-to-analog converter
379B: second digital-to-analog converter
380: drive voltage generation unit
392A: first nozzle control data transmission line
392B: second nozzle control data transmission line
394A: first connector
394B: second connector
396A: first latch signal line
396B: second latch signal line
400: drive waveform
402: jetting waveform
404: reverberation suppression waveform
410: first waveform element
412: second waveform element
414: third waveform element
416: fourth waveform element
418: fifth waveform element
500: graph
502: curve
504: curve
506: curve
510: recommended jetting frequency band
511: recommended jetting frequency band
512: non-recommended jetting frequency band
514: non-recommended jetting frequency band
520: graph
522: curve
524: first jetting frequency band
526: second jetting frequency band
560: drive waveform
562: first jetting waveform
564: second jetting waveform
566: third jetting waveform
568: first reverberation suppression waveform
580: drive waveform
582: fourth jetting waveform
584: fifth jetting waveform
586: sixth jetting waveform
588: second reverberation suppression waveform
600: liquid droplet
602: first position
604: second position
P: paper
$T_f$: pull period
$T_1$: period from start timing of push period of jetting waveform to end timing of drive waveform
$T_P$: pixel cycle
$T_r$: push period
$T_w$: width
S10 to S20: respective steps of head drive method

What is claimed is:

1. A head drive device comprising:

a drive waveform acquisition unit that acquires a drive waveform that is applied to a drive voltage of a one-pixel cycle and includes one or more jetting waveforms having a width of half of a resonant cycle of a jetting head to be driven;

a drive voltage generation unit that generates a drive voltage using the drive waveform;

a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit, wherein in a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head, wherein in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit sets the jetting frequency of the jetting head by using the period $T_1$ that satisfies $n \times T_c \leq T_1 \leq (n+1/2) \times Tc$.

2. The head drive device according to claim 1, wherein the drive waveform acquisition unit acquires a drive waveform including a non-jetting waveform continuous with a final waveform element in a final jetting waveform.

3. The head drive device according to claim 1, wherein the jetting frequency setting unit sets a jetting frequency corresponding to a minimum value of a curve representing the drop velocity with respect to the jetting frequency in the drop velocity information as the jetting frequency of the jetting head.

4. The head drive device according to claim 1, wherein the jetting frequency setting unit sets a jetting frequency at which an inclination of a curve representing the drop velocity with respect to the jetting frequency is 0 or less in the drop velocity information as the jetting frequency of the jetting head.

5. The head drive device according to claim 4, wherein in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit sets the jetting frequency of the jetting head by using the period $T_1$ that satisfies $$(N+1/4) \times T_c \leq T_1 \leq (n+1/2) \times Tc.$$

6. The head drive device according to claim 5, wherein the jetting frequency setting unit sets a jetting frequency corresponding to a minimum value of a curve representing the drop velocity with respect to the jetting frequency in the drop velocity information as the jetting frequency of the jetting head.

7. The head drive device according to claim 5, wherein the drive waveform acquisition unit acquires a drive waveform including a non-jetting waveform continuous with a final waveform element in a final jetting waveform.

8. The head drive device according to claim 4, wherein the jetting frequency setting unit sets a jetting frequency corresponding to a minimum value of a curve representing the drop velocity with respect to the jetting frequency in the drop velocity information as the jetting frequency of the jetting head.

9. The head drive device according to claim 4, wherein the drive waveform acquisition unit acquires a drive waveform including a non-jetting waveform continuous with a final waveform element in a final jetting waveform.

10. The head drive device according to claim 1, wherein the jetting frequency setting unit sets a jetting frequency corresponding to a minimum value of a curve representing the drop velocity with respect to the jetting frequency in the drop velocity information as the jetting frequency of the jetting head.

11. The head drive device according to claim 10, wherein the drive waveform acquisition unit acquires a drive waveform including a non jetting waveforms continuous with a final waveform element in a final jetting waveform.

12. The head drive device according to claim 1, wherein the drive waveform acquisition unit acquires a drive waveform including a non-jetting waveform continuous with a final waveform element in a final jetting waveform.

13. The head drive device according to claim 1, wherein the drive waveform acquisition unit acquires a drive waveform including a non-jetting waveform discontinuous with a final waveform element in a final jetting waveform.

14. The head drive device according to claim 1, further comprising:

a medium velocity information acquisition unit that acquires medium velocity information representing a movement velocity of a medium; and a jetting frequency adjusting unit that adjusts the jetting frequency using the medium velocity information.

15. A head device comprising:

a jetting head; and a head drive device that drives the jetting head, wherein the head drive device includes a drive waveform acquisition unit that acquires a drive waveform that is applied to a drive voltage of a one-pixel cycle and includes one or more jetting waveforms having a width of half of a resonant cycle of a jetting head to be driven;

a drive voltage generation unit that generates a drive voltage using the drive waveform;

a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit, wherein in a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head, wherein in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit sets the jetting frequency of the jetting head by using the period $T_1$ that satisfies $n \times T_c \leq T_1 \leq (n+1/2) \times Tc$.

16. A printing device comprising:

a jetting head; and a head drive device that drives the jetting head, wherein the head drive device includes a drive waveform acquisition unit that acquires a drive waveform that is applied to a drive voltage of a one-pixel cycle and includes one or more jetting waveforms having a width of half of a resonant cycle of a jetting head to be driven;

a drive voltage generation unit that generates a drive voltage using the drive waveform;

a jetting frequency setting unit that sets a jetting frequency of the jetting head on the basis of drop velocity information representing a relationship between the jetting frequency and a drop velocity in a case where a liquid droplet is jetted using the drive voltage of the one-pixel cycle; and a drive voltage supply unit that supplies the drive voltage to the jetting head by applying the jetting frequency set by using the jetting frequency setting unit, wherein in a case where a drop velocity of a jetting frequency band where the drop velocity is constant in the drop velocity information is defined as a first velocity and a drop velocity equal to or less than the first velocity is defined as a second velocity, the jetting frequency setting unit sets a jetting frequency at which the drop velocity is the second velocity as the jetting frequency of the jetting head, wherein in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit sets the jetting frequency of the jetting head by using the period $T_1$ that satisfies $n \times T_c \leq T_1 \leq (n+1/2) \times Tc$.

17. A head drive method comprising:

a drive waveform acquisition step of acquiring a drive waveform that is applied to a drive voltage of a one-pixel cycle and includes one or more jetting waveforms having a width of half of a resonant cycle of a jetting head to be driven;

a drive voltage generation step of generating a drive voltage using the drive waveform;

a jetting frequency setting step of setting a jetting frequency of the jetting head on the basis of drop velocity information representing a relationship between the jetting frequency and a drop velocity in a case where a liquid droplet is jetted using the drive voltage of the one-pixel cycle; and a drive voltage supply step of supplying the drive voltage to the jetting head by applying the jetting frequency set in the jetting frequency setting step, wherein in a case where a drop velocity of a jetting frequency band where the drop velocity is constant in the drop velocity information is defined as a first velocity and a drop velocity equal to or less than the first velocity is defined as a second velocity, the jetting frequency setting step sets a jetting frequency at which the drop velocity is the second velocity as the jetting frequency of the jetting head, wherein in a case where the resonant cycle is $T_c$, n is 1 or 2, a period from a start point of a final waveform element in a first drive waveform to a start point of a first waveform element in a second drive waveform corresponding to a next pixel cycle of the first drive waveform is $T_1$, the jetting frequency setting unit sets the jetting frequency of the jetting head by using the period $T_1$ that satisfies $n \times T_c \leq T_1 \leq (n+1/2) \times Tc$.

* * * * *